US007267637B2

(12) United States Patent
Mercado et al.

(10) Patent No.: US 7,267,637 B2
(45) **Date of Patent: *Sep. 11, 2007**

(54) EXERCISE AND THERAPEUTIC TRAINER

(75) Inventors: Fred Mercado, Laguna Hills, CA (US); John C. Rufino, Dolores, CO (US); Yong Ming Goh, Rancho Santa Margarita, CA (US)

(73) Assignee: Unisen, Inc., Irvine, CA (US)

( * ) Notice: Subject to any disclaimer, the term of this patent is extended or adjusted under 35 U.S.C. 154(b) by 142 days.

This patent is subject to a terminal disclaimer.

(21) Appl. No.: 11/154,850

(22) Filed: Jun. 16, 2005

(65) Prior Publication Data

US 2005/0245358 A1 Nov. 3, 2005

Related U.S. Application Data

(63) Continuation of application No. 10/028,451, filed on Oct. 22, 2001, now Pat. No. 6,908,416, which is a continuation-in-part of application No. 09/740,445, filed on Dec. 19, 2000, now Pat. No. 6,575,877, which is a continuation of application No. 09/249,189, filed on Feb. 12, 1999, now Pat. No. 6,183,398.

(60) Provisional application No. 60/093,927, filed on Jul. 23, 1998.

(51) Int. Cl.
*A63B 69/16* (2006.01)
*A63B 22/04* (2006.01)

(52) U.S. Cl. ..... 482/52; 482/57

(58) Field of Classification Search ..... 482/51, 482/52, 57, 70, 79–80
See application file for complete search history.

(56) References Cited

U.S. PATENT DOCUMENTS

| | | | |
|---|---|---|---|
| 219,439 | A | 9/1879 | Blend |
| 1,909,190 | A | 5/1933 | Sachs |
| 2,603,486 | A | 7/1952 | Hughes |
| 2,826,192 | A | 3/1958 | Mangas |
| 2,892,455 | A | 6/1959 | Hutton |
| 3,316,898 | A | 5/1967 | Brown |
| 3,432,164 | A | 3/1969 | Deeks |
| 3,475,021 | A | 10/1969 | Ruegsegger |
| 3,566,861 | A | 3/1971 | Weiss |
| 3,713,438 | A | 1/1973 | Knutsen |
| 3,756,595 | A | 9/1973 | Hague |
| 3,759,511 | A | 9/1973 | Zinkin |
| 3,824,994 | A | 7/1974 | Soderberg, Sr. |
| 3,970,302 | A | 7/1976 | McFee |

(Continued)

*Primary Examiner*—Stephen R. Crow
(74) *Attorney, Agent, or Firm*—Knobbe, Martens, Olson & Bear, LLP

(57) ABSTRACT

An exercise trainer having a first crank arm and a second crank arm respectively connected to a first foot link and a second foot link with foot pedals supported on the foot links, and bearing supports for the foot links removed from the crank arms. A flexible connection connects a ground point, the foot pedals, and the foot links to provide relative movement in a modified ellipse as to the ground point of at least twice the length of each crank arm. A seat is mounted on the trainer having a motor and control for raising and lowering the seat with respect to the foot pedals. The first and second crank arms are connected to a motor for driving the crank arms at a given speed which can supplement a user's effort or provide a load to a user beyond a given speed.

17 Claims, 16 Drawing Sheets

U.S. PATENT DOCUMENTS

| | | | | |
|---|---|---|---|---|
| 4,053,173 | A | 10/1977 | Chase, Sr. | |
| 4,185,622 | A | 1/1980 | Swenson | |
| 4,188,030 | A | 2/1980 | Hooper | |
| 4,379,566 | A | 4/1983 | Titcomb | |
| 4,456,276 | A | 6/1984 | Bortolin | |
| 4,496,147 | A | 1/1985 | DeCloux et al. | |
| 4,509,742 | A | 4/1985 | Cones | |
| 4,555,109 | A | 11/1985 | Hartmann | |
| 4,561,318 | A | 12/1985 | Schirrmacher | |
| 4,592,544 | A | 6/1986 | Smith | |
| 4,632,386 | A | 12/1986 | Beech | |
| 4,643,419 | A | 2/1987 | Hyde | |
| 4,645,200 | A | 2/1987 | Hix | |
| 4,679,786 | A | 7/1987 | Rodgers | |
| 4,685,666 | A | 8/1987 | DeCloux | |
| 4,708,338 | A | 11/1987 | Potts | |
| 4,709,918 | A | 12/1987 | Grinblat | |
| 4,720,093 | A | 1/1988 | Del Mar | |
| 4,733,858 | A | 3/1988 | Lan | |
| 4,779,863 | A | 10/1988 | Yang | |
| 4,786,050 | A | 11/1988 | Geschwender | |
| 4,786,068 | A | 11/1988 | Tang | |
| 4,786,069 | A | 11/1988 | Tang | |
| 4,850,585 | A | 7/1989 | Dalebout | |
| 4,869,494 | A | 9/1989 | Lambert, Sr. | |
| 4,900,013 | A | 2/1990 | Rodgers, Jr. | |
| 4,940,233 | A | 7/1990 | Bull | |
| 4,949,954 | A | 8/1990 | Hix | |
| 4,949,993 | A | 8/1990 | Stark | |
| 4,951,942 | A | 8/1990 | Walden | |
| 4,989,857 | A | 2/1991 | Kuo | |
| 5,000,442 | A | 3/1991 | Dalebout et al. | |
| 5,000,443 | A | 3/1991 | Dalebout et al. | |
| 5,039,087 | A | 8/1991 | Kuo | |
| 5,039,088 | A | 8/1991 | Shifferaw | |
| 5,040,786 | A | 8/1991 | Jou | |
| 5,048,821 | A | 9/1991 | Kuo-Liang | |
| 5,062,627 | A | 11/1991 | Bingham | |
| 5,078,389 | A | 1/1992 | Chen | |
| 5,131,895 | A | 7/1992 | Rogers, Jr. | |
| 5,135,447 | A | 8/1992 | Robards, Jr. | |
| 5,149,312 | A | 9/1992 | Croft | |
| 5,163,888 | A | 11/1992 | Stearns | |
| 5,186,697 | A | 2/1993 | Rennex | |
| 5,195,935 | A | 3/1993 | Fencel | |
| 5,238,462 | A | 8/1993 | Cinke | |
| 5,242,343 | A | 9/1993 | Miller | |
| 5,279,529 | A | 1/1994 | Eschenbach | |
| 5,290,211 | A | 3/1994 | Stearns | |
| 5,295,928 | A | 3/1994 | Rennex | |
| 5,299,993 | A | 4/1994 | Habing | |
| 5,320,588 | A | 6/1994 | Wanzer | |
| 5,346,447 | A | 9/1994 | Stearns | |
| 5,352,169 | A | 10/1994 | Eschenbach | |
| 5,383,829 | A | 1/1995 | Miller | |
| 5,401,226 | A | 3/1995 | Stearns | |
| 5,403,252 | A | 4/1995 | Leon | |
| 5,403,255 | A | 4/1995 | Johnston | |
| 5,419,747 | A | 5/1995 | Piaget | |
| 5,423,729 | A | 6/1995 | Eschenbach | |
| 5,496,235 | A | 3/1996 | Stevens | |
| 5,499,956 | A | 3/1996 | Habing | |
| 5,518,473 | A | 5/1996 | Miller | |
| 5,527,246 | A | 6/1996 | Rodgers, Jr. | |
| 5,529,554 | A | 6/1996 | Eschenbach | |
| 5,529,555 | A | 6/1996 | Rodgers, Jr. | |
| 5,540,637 | A | 7/1996 | Rodgers, Jr. | |
| 5,549,526 | A | 8/1996 | Rodgers, Jr. | |
| 5,549,529 | A | 8/1996 | Rasmussen | |
| 5,562,574 | A | 10/1996 | Miller | |
| 5,573,480 | A | 11/1996 | Rodgers, Jr. | |
| 5,577,985 | A | 11/1996 | Miller | |
| 5,591,107 | A | 1/1997 | Rodgers, Jr. | |
| 5,593,371 | A | 1/1997 | Rodgers, Jr. | |
| 5,593,372 | A | 1/1997 | Rodgers, Jr. | |
| 5,595,553 | A | 1/1997 | Rodgers, Jr. | |
| 5,611,756 | A | 3/1997 | Miller | |
| 5,611,757 | A | 3/1997 | Rodgers, Jr. | |
| 5,611,758 | A | 3/1997 | Rodgers, Jr. | |
| 5,616,106 | A | 4/1997 | Abelbeck | |
| 5,637,058 | A | 6/1997 | Rodgers, Jr. | |
| 5,653,662 | A | 8/1997 | Rodgers, Jr. | |
| 5,658,227 | A | 8/1997 | Stearns | |
| 5,683,333 | A | 11/1997 | Rodgers, Jr. | |
| 5,685,333 | A | 11/1997 | Skaryd | |
| 5,685,804 | A | 11/1997 | Whan-Tong | |
| 5,690,589 | A | 11/1997 | Rodgers, Jr. | |
| 5,692,994 | A | 12/1997 | Eschenbach | |
| 5,692,997 | A | 12/1997 | Stearns | |
| 5,707,321 | A | 1/1998 | Maresh | |
| 5,733,227 | A | 3/1998 | Lee | |
| 5,735,773 | A | 4/1998 | Vittone | |
| 5,735,774 | A | 4/1998 | Maresh | |
| 5,738,614 | A | 4/1998 | Rodgers, Jr. | |
| 5,741,205 | A | 4/1998 | Doll | |
| 5,743,832 | A | 4/1998 | Sands | |
| 5,743,834 | A | 4/1998 | Rodgers, Jr. | |
| 5,746,683 | A | 5/1998 | Lee | |
| 5,749,809 | A | 5/1998 | Lin | |
| 5,755,642 | A | 5/1998 | Miller | |
| 5,755,643 | A | 5/1998 | Sands | |
| 5,755,645 | A | 5/1998 | Miller | |
| 5,759,135 | A | 6/1998 | Chen | |
| 5,759,136 | A | 6/1998 | Chen | |
| 5,762,588 | A | 6/1998 | Chen | |
| 5,766,113 | A | 6/1998 | Rodgers, Jr. | |
| 5,769,760 | A | 6/1998 | Lin et al. | |
| 5,772,558 | A | 6/1998 | Rodgers, Jr. | |
| 5,776,035 | A | 7/1998 | Chen | |
| 5,779,598 | A | 7/1998 | Lee | |
| 5,779,599 | A | 7/1998 | Chen | |
| 5,782,722 | A | 7/1998 | Sands | |
| 5,788,609 | A | 8/1998 | Miller | |
| 5,788,610 | A | 8/1998 | Eschenbach | |
| 5,792,026 | A | 8/1998 | Maresh | |
| 5,792,028 | A | 8/1998 | Jarvie | |
| 5,792,029 | A * | 8/1998 | Gordon | 482/52 |
| 5,795,268 | A | 8/1998 | Husted | |
| 5,800,315 | A | 9/1998 | Yu | |
| 5,803,871 | A | 9/1998 | Stearns | |
| 5,803,872 | A | 9/1998 | Chang | |
| 5,813,949 | A | 9/1998 | Rodgers, Jr. | |
| 5,820,524 | A | 10/1998 | Chen | |
| 5,823,914 | A | 10/1998 | Chen | |
| 5,823,917 | A | 10/1998 | Chen | |
| 5,823,919 | A | 10/1998 | Eschenbach | |
| 5,830,112 | A | 11/1998 | Wang | |
| 5,836,854 | A | 11/1998 | Kuo | |
| 5,836,855 | A | 11/1998 | Eschenbach | |
| 5,846,166 | A | 12/1998 | Kuo | |
| 5,848,954 | A | 12/1998 | Stearns et al. | |
| 5,857,940 | A * | 1/1999 | Husted | 482/51 |
| 5,857,941 | A | 1/1999 | Maresh et al. | |
| 5,860,895 | A | 1/1999 | Lee | |
| 5,865,712 | A | 2/1999 | Chang | |
| 5,868,650 | A | 2/1999 | Wu | |
| 5,876,307 | A | 3/1999 | Stearns | |
| 5,876,308 | A | 3/1999 | Jarvie | |
| 5,879,271 | A | 3/1999 | Stearns et al. | |
| 5,882,281 | A | 3/1999 | Stearns et al. | |
| 5,893,820 | A | 4/1999 | Maresh et al. | |
| 5,895,339 | A | 4/1999 | Maresh | |
| 5,899,833 | A | 5/1999 | Ryan et al. | |
| 5,911,649 | A | 6/1999 | Miller | |

5,913,751 A 6/1999 Eschenbach
5,916,064 A 6/1999 Eschenbach
5,916,065 A 6/1999 McBride
5,919,118 A 7/1999 Stearns et al.
5,921,894 A 7/1999 Eschenbach
5,924,962 A 7/1999 Rodgers, Jr.
5,924,963 A 7/1999 Maresh
5,928,114 A 7/1999 Chen
5,938,567 A 8/1999 Rodgers, Jr.
5,938,568 A 8/1999 Maresh et al.
5,938,570 A 8/1999 Maresh
5,947,872 A 9/1999 Ryan et al.
5,957,814 A 9/1999 Eschenbach
5,961,423 A 10/1999 Sellers
5,967,944 A 10/1999 Vittone
5,971,892 A 10/1999 Lee
5,989,159 A 11/1999 Chen
5,993,359 A 11/1999 Eschenbach
5,997,445 A 12/1999 Maresh
6,004,244 A 12/1999 Simonson
6,007,462 A 12/1999 Chen
6,017,294 A 1/2000 Eschenbach
6,019,710 A 2/2000 Dalebout
6,022,296 A 2/2000 Yu
6,024,676 A 2/2000 Eschenbach
6,027,430 A 2/2000 Stearns
6,027,431 A 2/2000 Stearns
6,030,320 A 2/2000 Stearns
6,036,622 A 3/2000 Gordon
6,042,512 A 3/2000 Eschenbach
6,045,487 A 4/2000 Miller
6,045,488 A 4/2000 Eschenbach
6,053,847 A 4/2000 Stearns
6,063,008 A 5/2000 McBride
6,063,009 A 5/2000 Stearns
6,077,196 A 6/2000 Eschenbach
6,077,198 A 6/2000 Eschenbach
6,080,086 A 6/2000 Maresh
6,090,013 A 7/2000 Eschenbach
6,090,014 A 7/2000 Eschenbach
6,099,439 A 8/2000 Ryan et al.
6,113,518 A 9/2000 Maresh
6,123,650 A 9/2000 Birrell
6,126,573 A 10/2000 Eschenbach
6,126,574 A 10/2000 Stearns
6,135,923 A 10/2000 Stearns
6,135,926 A 10/2000 Lee
6,135,927 A 10/2000 Lo
6,142,915 A 11/2000 Eschenbach
6,146,313 A 11/2000 Whan-Tong et al.
6,146,314 A 11/2000 Lee
6,149,551 A 11/2000 Pyles et al.
6,152,859 A 11/2000 Stearns
6,159,132 A 12/2000 Chang
6,165,107 A 12/2000 Birrell
6,168,552 B1 1/2001 Eschenbach
6,171,215 B1 1/2001 Stearns
6,171,217 B1 1/2001 Cutler
6,176,814 B1 1/2001 Ryan et al.
6,183,397 B1 2/2001 Stearns et al.
6,190,289 B1 2/2001 Pyles et al.
6,196,948 B1 3/2001 Stearns
6,846,272 B2 1/2005 Rosenow et al.
6,908,416 B2 * 6/2005 Mercado et al. ..... 482/52

* cited by examiner

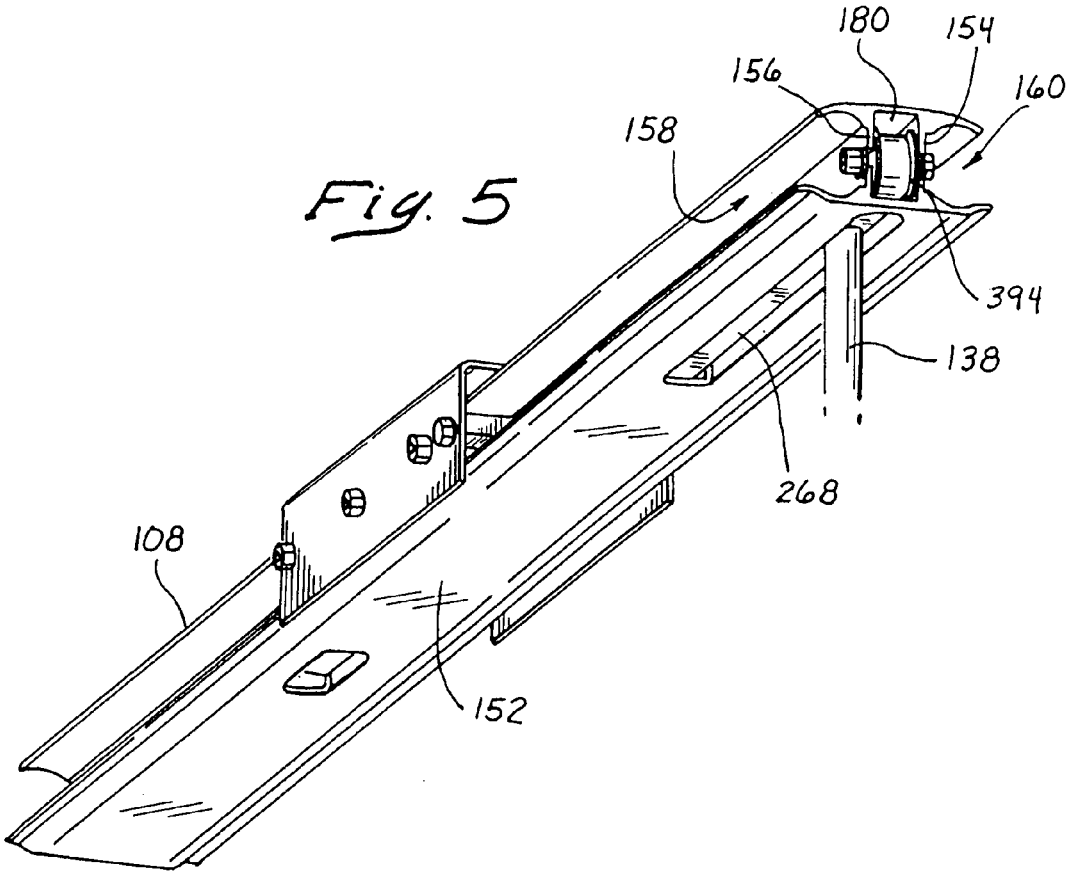
Fig. 5
Fig. 8
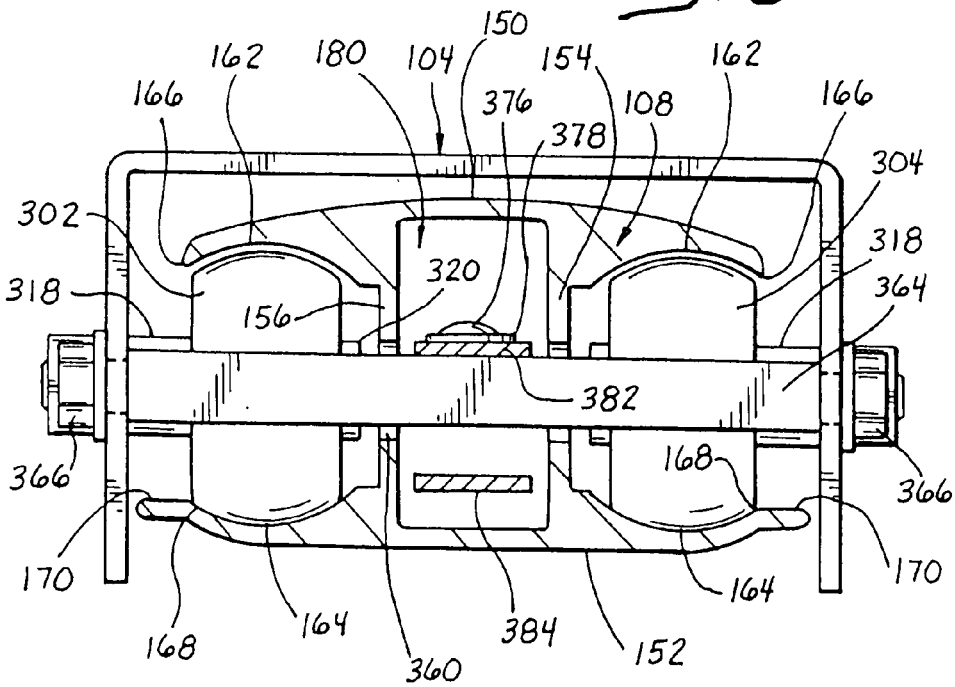

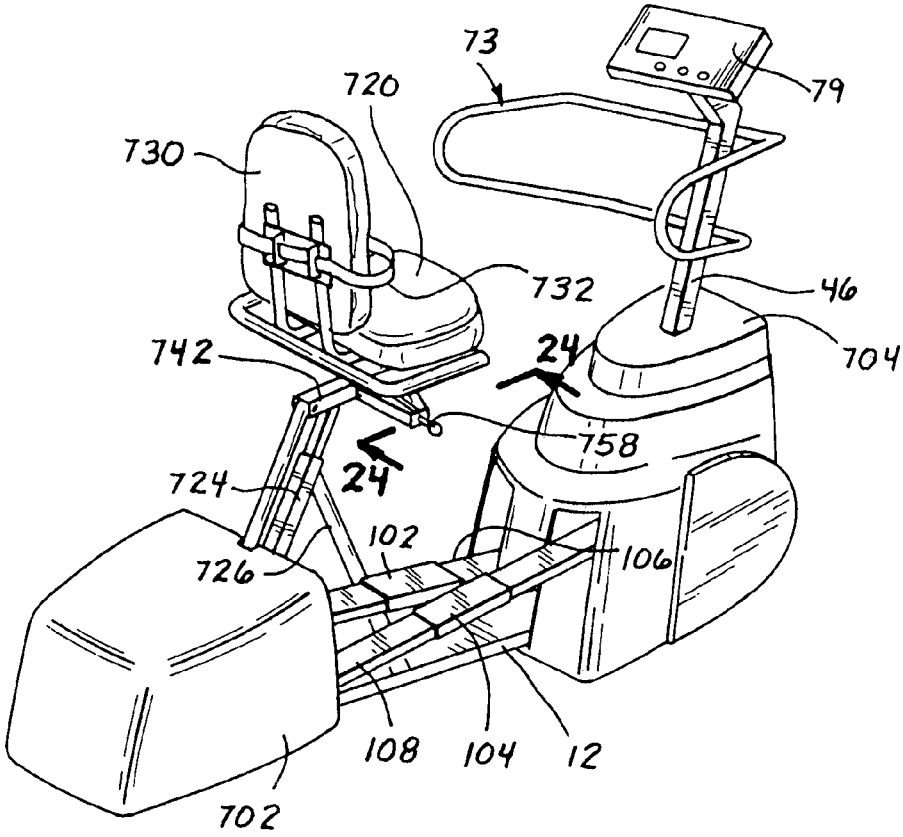
Fig. 19
Fig. 23
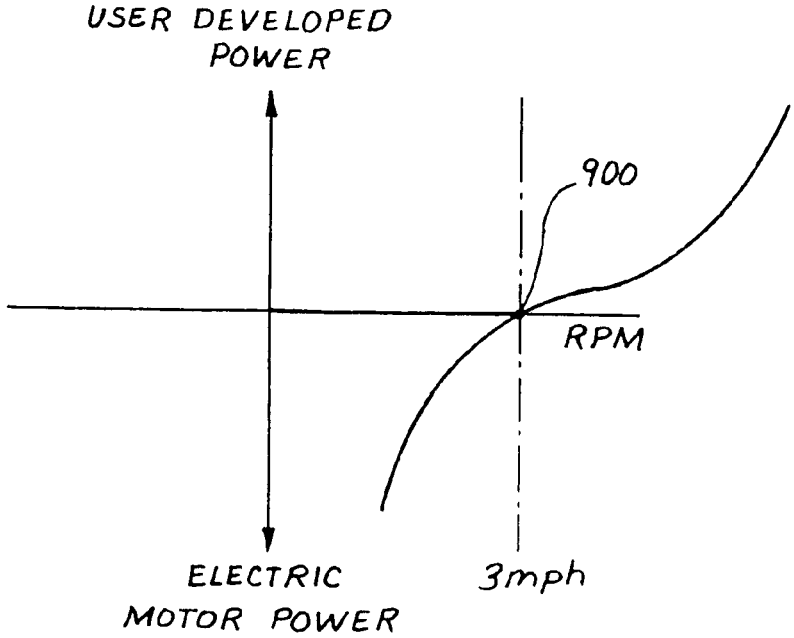

Fig. 24
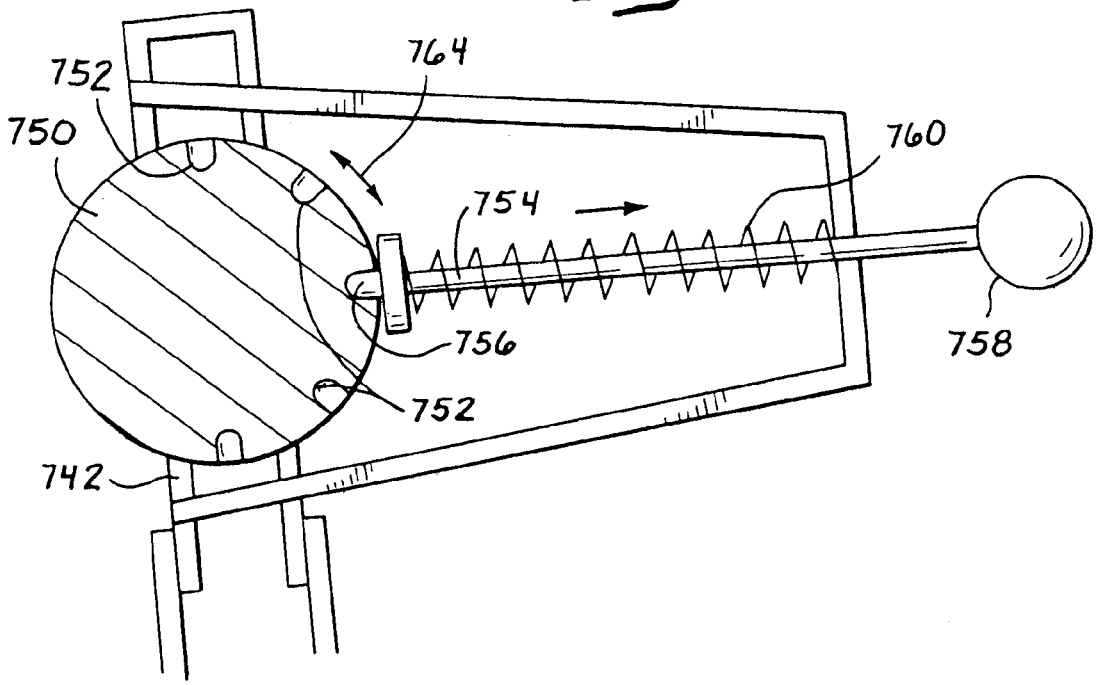
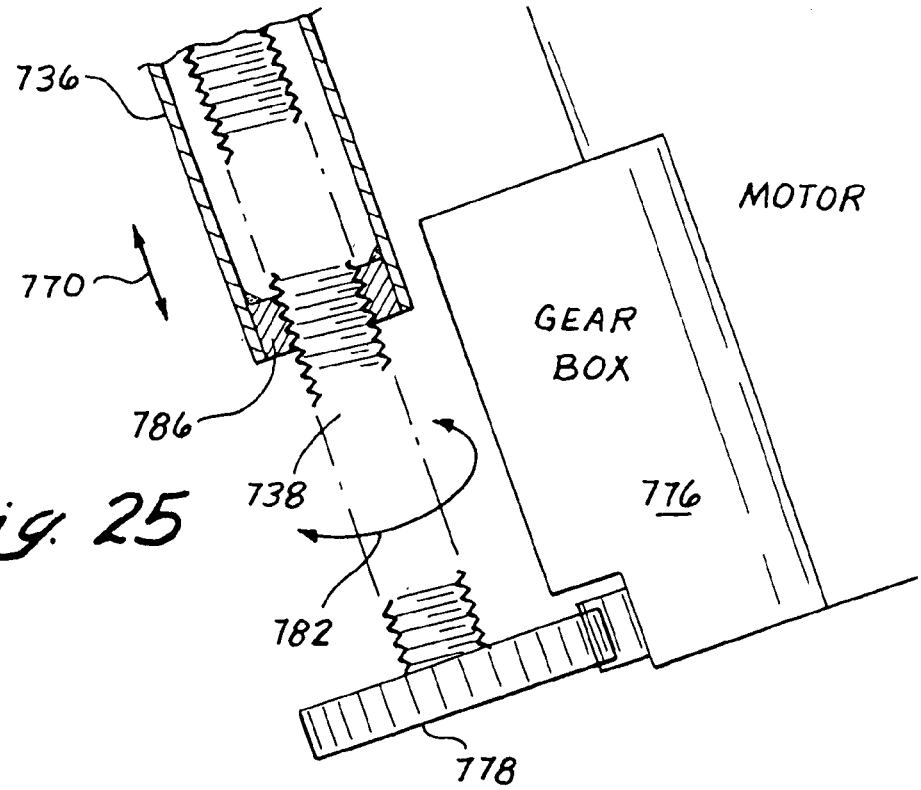
Fig. 25

EXERCISE AND THERAPEUTIC TRAINER

CROSS-REFERENCE TO RELATED APPLICATIONS

This application is a continuation of U.S. patent application Ser. No. 10/028,451, filed Oct. 22, 2001 and issued as U.S. Pat. No. 6,908,416 B1 on Jun. 21, 2005, which is a continuation-in-part of U.S. patent application Ser. No. 09/740,445, filed Dec. 19, 2000 and issued as U.S. Pat. No. 6,575,877 B1 on Jun. 10, 2003, which is a continuation of U.S. patent application Ser. No. 09/249,189, filed Feb. 12, 1999 and issued as U.S. Pat. No. 6,183,398 B1 on Feb. 6, 2001, which claims the benefit of U.S. Provisional Application No. 60/093,927, filed Jul. 23, 1998.

Your Petitioners, Fred Mercado, a citizen of the United States of America and a resident of Orange County, in the State of California, whose residence and post office address are 24681 Mendocino, Laguna Hills, Calif. 92653; John C. Rufino, a citizen of the United States of America and a resident in the State of Colorado, whose residence and post office address are 18020 CR 27.8, Dolores, Colo. 81323; and, Yong Ming Goh, a citizen of Malaysia and a resident of Orange County, in the State of California, whose residence and post office address are 5 Via Berrando, Rancho Santa Margarita, Calif. 92688 pray that letters patent may be granted to them for the invention of an EXERCISE AND THERAPEUTIC TRAINER as set forth in the following Specification.

BACKGROUND OF THE INVENTION

1. Field of the Invention

This invention pertains to exercise apparatus which is in the form of a trainer that provides a simulated walking or running stride. The trainer of this invention falls within the field of exercise and therapeutic devices such as stepping machines, simulated cross country ski machines, stationary bicycles, as well as other types of exercise trainers. It more particularly relates to those types of exercise trainers within the art and background related to pedals that can be reciprocated as attached to a pair of cranks to provide for a simulated walking or running motion for both exercise and physical therapy.

2. Description of the Related Art

Exercise and therapeutic training devices come in many forms. As is generally known, such exercise devices can include stationary bicycles such as those of the reclining and vertical type. Further to this extent, there are such devices that are simulated stepping machines which allow one to step upwardly and downwardly to simulate a climbing of stairs. Also well known are treadmills that simulate running, jogging, and walking vigorously.

There are other well known devices that not only include cycling but also efforts related to treadmill workouts.

Treadmills generally permit a user to walk, jog or run on a stationary machine. However, they are considered impact devices which in some cases are not as beneficial to the user as for example a low impact device such as a bicycle whether it be a reclining or vertical bicycle or such stepping machines as are known in the art.

There are exercise trainers that are currently known in the art that simulate a running, walking, or jogging effort on a pair of pedals. These pedals are physically connected to cranks that are under a load. Such exercise trainers can have their pedals trace a path approximating an ellipse or what can be considered as a modified elliptical path. One of the drawbacks of such modified elliptical paths is that the major axis of the path is limited to being twice the crank's length.

When the foregoing translates to the diameter of the wheel or disk under load that is being driven, it creates a significantly high pedal step up. This does not provide sufficient aerobic effort nor provide for enough hip flexure to maximize a cardiovascular workout through the leg, hip, quadriceps, and other muscle portions of the body. Also, when used as a physical therapy device, it is cumbersome, bulky, high, and difficult for a patient to use.

In order to overcome the deficiencies of the prior art, this invention utilizes a unique relative motion concept with respect to the foot links and the foot pedals. The invention in order to accomplish this, utilizes a foot pedal mounted with rollers on a foot link. This allows relative motion when the foot pedal has been maintained by a relationship to a ground or non-moving portion. The foot pedal moves in relationship to a fixed or grounded area such as the frame.

A flexible belt like element that can be in the form of a belt, chain, cable, or other member allows the foot pedal to slide relative to the foot link as the foot link reciprocates backwardly and forwardly. In effect, the flexible member pulls the foot pedal relative to the foot link in the direction of foot link travel. The net effect is to increase the stride length by a factor of approximately four relative to ground. The normal relative movement would be approximately two times the crank length The foot links with the flexible member when moving backwardly cause a pulling of the foot pedals backwardly along the length of the foot link. This creates a stride with a modified elliptical motion while at the same time maintaining a small crank diameter.

The exercise and therapeutic trainer of this device is particularly enhanced by providing a seat for physical therapy. The seat allows a patient to sit on the trainer. The patient can then use the foot pedals in a manner whereby the patient can move them with a modified limited effort. In particular, a lesser effort than is normally required can be effected by having a motor drive the foot pedals and the foot links. The action emulates a more natural gait or stride to return the rehabilitating patient to walking and running capability.

The motor when driving the foot links and pedals allows a therapy patient to move their respective legs and feet in a manner to provide therapy at a particularly desired level of effort for that particular patient. For instance, the level of therapy can be changed by an automatic adjustment on a panel to allow for increases or decreases in overall speed and effort.

Furthermore, the motor driving the pedals of the therapy unit can be overdriven by the patient beyond the motor driven movement. This overdrive by the patient allows the motor to exert a braking effort on the patient so that a certain amount of positive effort is required upon the part of the patient for therapy purposes. In this manner the patient exerts more effort as they regain strength during the rehabilitating process.

SUMMARY OF THE INVENTION

In summation, this invention comprises an exercise and physical therapy trainer having a load or motor drive which can be increased or decreased by appropriate control applied to rotational cranks which are in turn connected to a pair of foot links having foot pedals provided with relative movement to multiply the distance which the foot links move with an adjustable seat provided for physical therapeutic activity.

More specifically, the invention incorporates a pair of foot links which are supported on rollers at one end for reciprocating movement. At the other end, the foot links are attached to a pair of cranks.

The entire trainer is supported on an underlying frame. Attached to the frame is a ground point. The ground point can extend from a post or columnar support or other means. The ground point allows for attachment of a flexible member in a fixed grounded relationship. The flexible member is comprised of a belt, chain, cable, or other means to allow the relative movement of the foot link to pull the foot pedal or drive it backwardly as the foot link oscillates in a reciprocal movement.

The foregoing reciprocal oscillating movement of the foot link accommodates the flexible member by having the flexible member looped and carried as a continuous member around two support pulleys at either end. The support pulleys allow for the flexible member to move around them and at the same time be driven by the foot link.

Attached to the foot pedal is an anchor to which the flexible member is attached in a fixed manner. The flexible member is also anchored to the frame to form a fixed location relative to motion of the foot pedal. In this manner, as the foot link reciprocates backwardly, it tends to drive the flexible member pulling the foot pedal. The foregoing relative motion provides for an approximate doubling motion to increase the reciprocal movement of the foot pedal to approximately four times that of what would normally be the distance of the crank length.

Alternative embodiments of this invention also incorporate a flexible member looped around multiple rollers connected to the foot link so as to allow the reciprocal movement to be multiplied by a factor of approximately six or eight times the crank length.

This invention is particularly efficacious for therapy of physically handicapped and injured people such as stroke victims, victims of leg injuries, and other situations requiring physical therapy. The invention is enhanced by a seat which can be adjusted by a motor. The seat can be swung to either side to allow for a patient to be placed on the seat and then moved to a centrally oriented location. The patient's feet can then be placed on the pedals of this invention. After placement on the pedals, the particular speed of movement can be set.

This is done through a motor drive including a D.C. brush motor. The D.C. brush motor turns the cranks of the trainer thereby turning the foot links and pedals through the linkage. This causes the patient's legs to move in response to being placed on the foot pedals. The particular desired movement can be adjusted to a particular speed of walking depending upon the level of capability by the patient.

Additionally, the D.C. brush motor can be overdriven by the patient when the patient is able to exert an effort. This overdrive allows the patient to move in a particular manner and exert a certain force on the pedals. The pedals can then be controlled in the overdrive mode and provided with a particular force through a resistance on the D.C. brush motor or other suitable resistance.

BRIEF DESCRIPTION OF THE DRAWINGS

FIG. 5 shows a view looking upwardly at the foot link and foot pedal in a perspective view whereby the ground point is shown extending through a slot within the foot link.

FIG. 8 shows an end view of the foot pedal as sectioned and seen in the direction of lines 8-8 of FIG. 3.

FIG. 19 shows a perspective view of the physical therapy exerciser of this invention looking from the rear thereof.

FIG. 23 is a graph showing the load and drive efforts respectively of a user and the motor as set forth with regard to the RPM and the related miles per hour.

FIG. 24 shows the moving seat adjustment in the direction of lines 24-24 of FIG. 19.

FIG. 25 shows a detailed sectional view of the seat adjustment of this invention.

DETAILED DESCRIPTION OF THE PREFERRED EMBODIMENT

Figure 1:
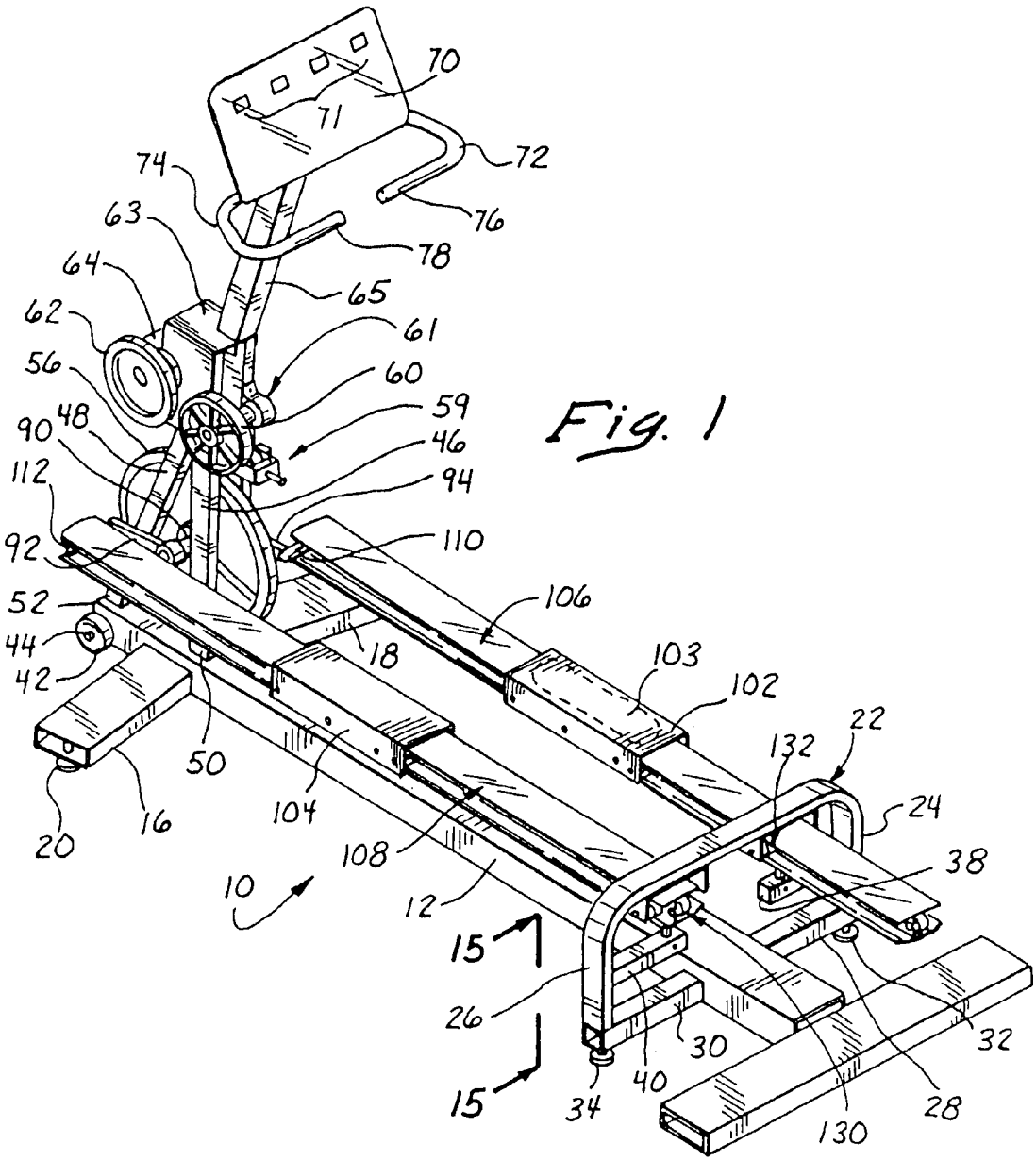
FIG. 1 shows a perspective view of the exercise trainer of this invention with the moving elements connected to a stand which can be used to support the arms of a user.

Looking more particularly at FIG. 1, which is a perspective view showing the exercise trainer of this invention, it can be seen that a frame 10 is generally shown having a longitudinal base member 12. The longitudinal base member 12 terminates at an end portion 14 forming a T shaped cross member at the rear thereof.

At the front, a pair of angular cross members 16 and 18 are shown. These angular cross members 16 and 18 are welded to the longitudinal frame member 12. Angular cross members 16 and 18 have leveling pads 20 on either side. The leveling pad of cross member 18 is hidden from view but is identically placed as the leveling pad 20 of cross member 16. These tend to level and orient the frame 10 and the attendant exerciser supported thereon.

In order to support the foot links at the rear, an inverted U shaped frame 22 is provided. The inverted U shaped frame member 22 has a horizontal portion and two depending portions 24 and 26. These vertical or upright portions 24 and 26 respectively terminate in a pair of box extension frame members 28 and 30. The respective box extension frame members 28 and 30 are welded or suitably bolted to the longitudinal member 12 to provide stability to the entire frame 10.

Welded to the horizontal portion of the U shaped frame 22 is the main support roller bracket 198, containing main support rollers 190 and 192.

Welded to and extending from the upright portions 24 and 26 are the left and right grounding shafts 138 supports 38 and 40. The grounding shaft supports 38 and 40 respectively extend inwardly in a lateral manner from the uprights 24 and 26. These extending inwardly oriented members 38 and 40 are such wherein they provide a ground for the flexible member. The ground extends from members 38 and 40 down through the uprights 24 and 26 to the base of the frame as leveled and set upon the leveling pads 32 and 34.

In order to provide for a level orientation, the cross members 28 and 30 respectively have leveling pads 32 and 34. These allow for leveling of the entire frame comprising cross members 16, 18 and 30 and 32 along with the terminal T shaped portion 14.

Connected to the front of the longitudinal member 12 is a pair of rollers 42 which are journaled with a pin 44 so that the frame 10 in its entirety can be rolled.

The frame 10 supports an upright member 46 braced by an angular member 48. The upright member 46 and angular member 48 are welded or secured in any suitable manner such as rivets, bolts, or metal flange inserts and mating slots into the base member 12. This can be seen where they are secured at portions respectively 50 and 52. As an aside, the securement of the various metal frame members can be made by welding, bolts, rivets, inserts, tabs, locking tabs, plastic joiners, or linking connectors which are well known in the art.

The upright 46 and the bracing member 48 is provided on both sides of the drive pulley disk or wheel 56.

The braking or load on the movement is provided by means of an electric or mechanical loading system, alternator, generator, rheo, magnetic, eddy current, etc. In the alternative, a mechanical brake such as caliper brakes known in the art can be used to squeeze the rim of the disk or wheel 56. When the pedals are driven, the load is substituted with a D.C. brush motor. This provides movement of the pedals for light exercise and physical therapy.

In this particular case, the drive pulley 56 is operationally connected by a belt to a pulley or sheave 60 which in turn is connected by a second belt to a second pulley or sheave 62 which has a peripheral mass to serve as a flywheel. The second pulley or sheave 62 acting as a flywheel is also the flywheel attached to the mechanical, electrical or electromagnetic load device, alternator, generator, rheo, magnetic, etc., or when driven, to the D.C. brush motor. This provides resistance or drive to the flywheel which in turn provides resistance or drive to the crank pulley 56. As the crank pulley rotates, its movement is transmitted to the flywheel. This movement is constantly transmitted back to the crank pulley to create a smooth motion to the user.

The resistance can be changed by requiring the loading device to increase the resistance, thereby changing the load on the drive pulley 56 and the reflective load to the foot links. In the alternative, when a motor is utilized it provides positive drive to the foot links.

In order to allow the user full access to variations and resistance, a panel 70 which includes a switch bank 71 is shown. The panel 70 is merely for descriptive purposes but can include various inputs in the way of mechanical electronic or touch switches so that variations in resistance or drive from a D.C. brush motor can take place. In order to allow for the user to have access and balance oneself, a pair of handle bars 72 and 74 are shown to which the user can grip at handle portions 76 and 78. Thus, a grip can be maintained and at the same time changes in loading can take place by the switch means that can be emplaced on the panel 70 such as switches in the form of the switch bank 71 that are shown.

The drive system through the sheaves or pulleys 60 and 62 can be interconnected by any suitable drive including the journal housing 61 as shown having the bearing support or pillow block for the sheave 60. Also, various controls can be utilized to tension the belt connected between crank pulley and sheave 60 through the idler pulley 59 as shown. Frame members can be utilized other than the frame members shown including the upright support 65 connected to the rigid support box 63 which is in turn welded or connected to the upright 46 and bracing member 48. Also, parallel bracing members on the other side such as those symmetrically opposite upright 46 and angular bracing 48 can be included.

The exercise and physical therapy trainer hereof is such wherein a user positions oneself on the exerciser foot pedal portions 102 and 104. The foot pedal portions 102 and 104 are supported on pedal links 106 and 108. The pedal links 106 and 108 comprise extruded beam or drive rod portions in the form of an extrusion having a central cross-sectional area formed as a general channel, tunnel, or void 180 and two channel portions 158 and 160 on either side. These will be detailed hereinafter in the cross-sectional showings of the extrusion. However, any suitable links having various cross sections can be utilized so long as they allow the connections for driving the foot pedals 102 and 104.

Each of the pedal links 106 and 108 are connected respectively to their crank members 94 and 92 by means of journaled pivoting crank arm journaled extensions 110 and 112. The crank extensions 110 and 112 extend into openings and bearings within the foot links 106 and 108 as can be seen in the bearing guide shown in FIG. 4, namely bearing guide 113. These crank arm journaled extensions 110 and 112 can be formed as any crank arm extension providing for a pivotal or rotational journaled attachment to the crank arms 92 and 94 so as to create a rotational end member in the form of the crank extensions 110 and 112 analogous to those of a bicycle pedal support. The extensions 110 and 112 are pivotally connected and journaled by bearings to the pedal links 106 and 108 at bearings 113.

The foregoing allows the pedal links to move in a reciprocating manner on the rotationally supported bearings or shafts 110 and 112. This reciprocating motion can be analogous to any reciprocators which are attached to a rotational movement for translation of rotational movement by a crank into reciprocating movement such as is well known in the form of pitman rods, crank connections, drive shafts and other forms for creating reciprocating motion from rotational motion.

Mounted on the pedal links 106 and 108 are the two respective pedal portions 102 and 104. The pedal portions can be formed in any suitable manner. However, in this case they are shown as inverted box shaped 90° U shaped members or rectangular channels. The box shaped or rectangular channel members forming the pedal portions 102 and 104 are provided with some means for receiving a user's foot. This has been shown in the form of the outline 103 on pedal portion 102 that can be a foot pad with a heel cup, a cup shaped element with upstanding lips, or lipped edges, or a shoe like member into which a user's foot can be emplaced. The foot pedals 102 and 104 are such wherein they support a user's foot which can be connected in any particular manner or received on top in the form of a foot conforming portion such as outline 103.

Figure 13:
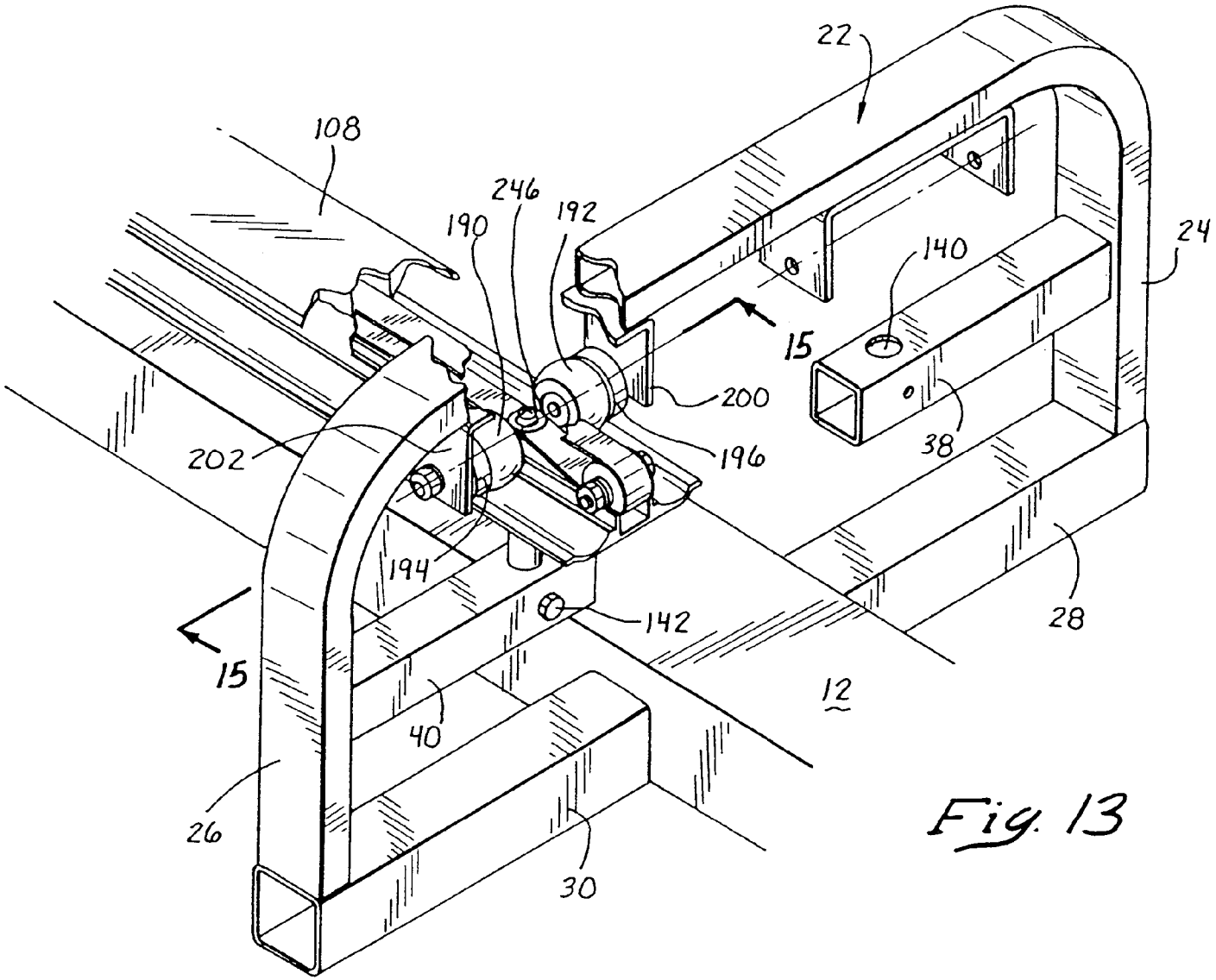
FIG. 13 shows a fragmented perspective view with the support frame broken away to detail the end rollers which support the foot link as well as the pulley upon which the flexible member is wrapped around.
Figure 15:
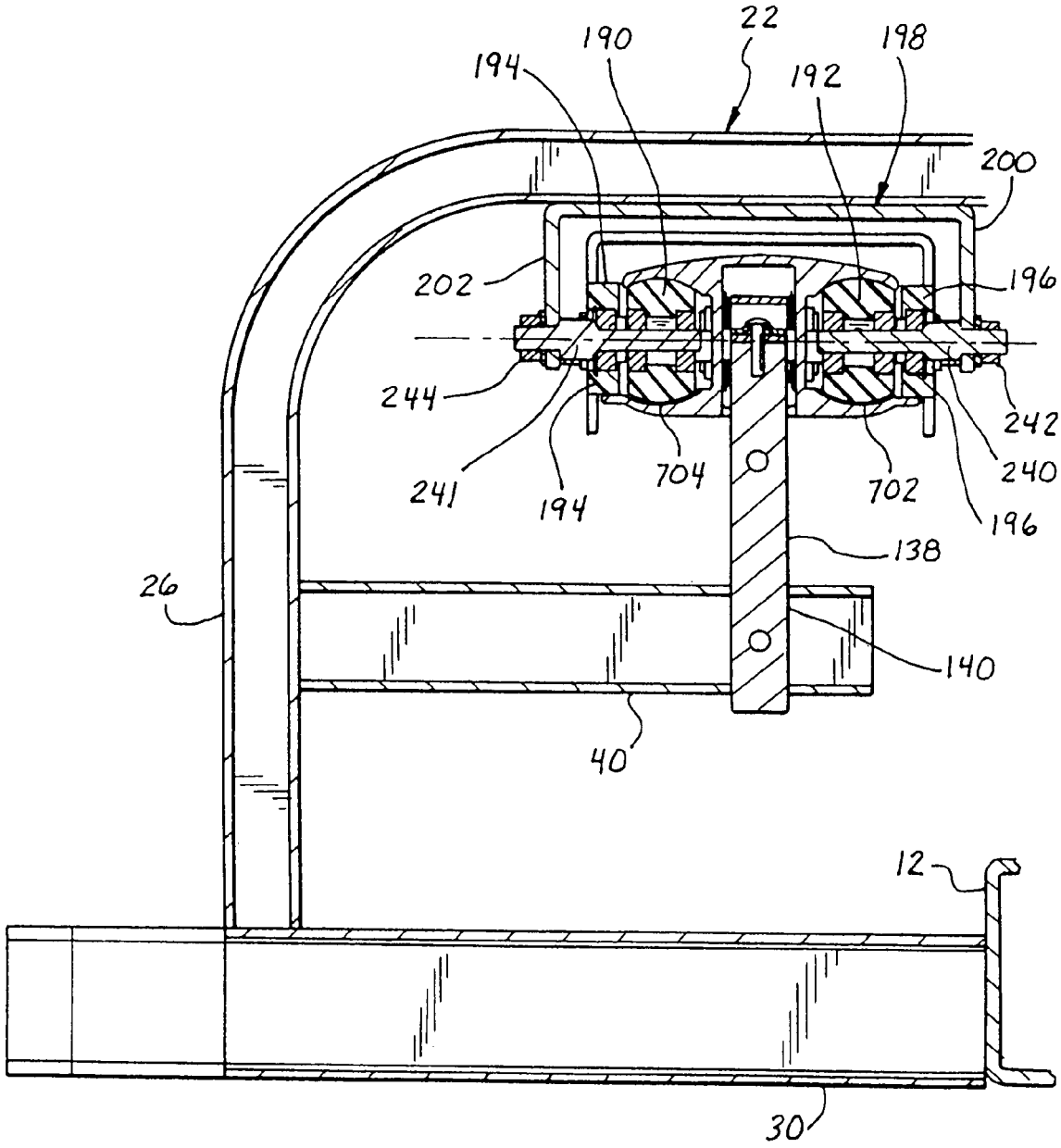
FIG. 15 shows a sectional view of the rear support rollers supporting the foot link as sectioned along lines 15-15 of FIG. 1.

At the distal end from the cranks 92 and 94, the pedal links 106 and 108 are supported on a grouping of rollers 130 and 132 having rollers which will be detailed hereinafter. In order to view the roller groupings 130 and 132 more carefully, a view thereof can be seen in greater detail in FIGS. 13 and 15. FIG. 13 is a perspective fragmented view thereof showing support of the pedal link 108. This can be seen clearly wherein the inverted U shaped portion 22 with its uprights 24 and 26 are shown supporting the underlying lateral ground support member 40. Extending from the ground support member 40 is a ground or upright column 138. The ground support, or upright member 138 is seated within an opening shown analogous to that of opening 140 having a pin or other means such as a bolt 142 passing therethrough and securing it. The ground 138 can be connected to anything so long as it provides suitable ground connection as will be detailed hereinafter. At its non-grounded end, ground 138 attaches to a flexible member so that a portion of the flexible member does not move with respect to ground as the foot link 108 reciprocates backwardly and forwardly.

In order to support the foot link 108, it can be seen that the roller system or grouping 130 has been shown which is analogous to roller system or grouping 132 which supports foot link 106.

Figure 6:
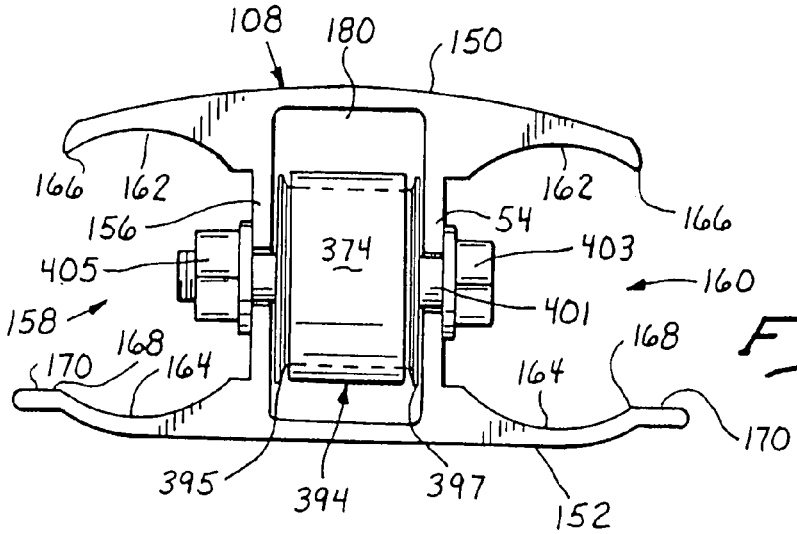
FIG. 6 shows an end view of the foot link as seen in the direction of lines 6-6 of FIG. 4.

In order to facilitate understanding of the support on the roller support system 130, it should be understood that the foot link 108 comprises an elongated beam like section that has been extruded with a pair of channels 158 and 160 on either side, and with an internal elongated tunnel chamber or passage 180. In particular, looking at FIGS. 4, and 5, it can be seen wherein the foot link 108 is shown having an upper slightly curved flat portion 150 and a lower portion 152. The upper and lower portions 150 and 152 are joined by a pair of internal webs 154 and 156. These internal webs 154 and 156 can be seen more specifically in FIGS. 6, 7 and 8 which shows the end and cross-sections of the foot link 108.

In particular, webs 154 and 156 interconnect the upper portions 150 and 152 so that a pair of channels 158 and 160 are provided. The channels 158 and 160 have upper and lower convex curvilinear surfaces 162 and 164 respectively at the tops and bottoms thereof. These curvilinear convex internal surfaces 162 and 164 allow for a generally rounded seating of rollers which roll therein and capture them at the outer limits or downturned and upturned lips respectively 166 and 168.

Extending from the upturned lips 168, are a pair of flat surfaces 170 which are bilaterally symmetrical and allow for secondary guide rollers to be received on the flat surfaces thereof. Thus, the foot link 108 comprise two channel portions 158 and 160 divided by upright webs 154 and 156 and also have a tunnel, elongated cavity, or interior passage 180 passing therethrough. The interior passage 180 is such where it receives a flexible member to be detailed hereinafter.

The foot link extrusion 108 can be formed in any suitable manner. The criteria is that it be able to reciprocate either on rollers, links, or other means. For instance, a mechanical linkage can be utilized in the form of arms on which the foot link 108 moves backwardly and forwardly. In this manner, movement of the foot link reciprocally can be in any manner to provide for reciprocal movement, as well as by pneumatic and fluidic means in the form of pistons, cylinders, or other supports. Any such support means in order to allow the foot link 108 to move backwardly and forwardly can be utilized for reciprocating movement of the foot links 106 and 108 with respect to the rotational movement of the cranks 92 and 94. In effect, it is not necessary to have the support roller system 130 and 132 or the configuration of the foot links 106 and 108 as shown as long as a sliding reciprocal and tilting or other movement can be established such as on a pivoting upright support member or link which rotates backwardly and forwardly such as a bell crank member, upright pneumatically pivoting strut, or arcuately turning extension member connected to a pneumatic or hydraulic damper.

In order to support the foot link 108 in the channels 158 and 160, a pair of main support rollers 190 and 192 are utilized. These respective rollers 190 and 192 are received respectively within the channels 158 and 160. These rollers 190 and 192 have a partial curvilinear cross-section which generally conforms to the upper and lower channels respectively 162 and 164. Thus smooth rolling contact is established while at the same time engaging and checking the movement of the foot link 108 from lateral sway.

Rollers 190 and 192 are machined slightly smaller in diameter than the opening of 162 and 164 as seen in gaps 702 and 704. These gaps 702 and 704 allow clearance between rollers 190 and 192 and foot links 108 to provide a smooth and quiet rolling.

The rollers 190 and 192 fundamentally are such wherein they support the foot links 106 and 108 in their reciprocal movement and are assisted by means of two flat rollers 194 and 196. These flat rollers 194 and 196 can be seen in greater detail in FIG. 15. These particular flat rollers are designed to have a smaller gap from the flat surface 170 on the extrusion. During normal operation, as the user's weight presses down on the foot links, only the main support roller is in contact and rolling as the foot links reciprocate. Any uplifting force on the foot links during the operation will disengage the extrusion from the main support rollers 190 and 192 and extrusion's flat 170 will roll on the flat rollers 194 and 196.

The rollers 190, 192, 194 and 196 are supported for movement by a depending bracket 198 that has two lateral depending walls or bracket portions 200 and 202. The depending bracket portions 200 and 202 have openings which receive a pair of axles 240 and 241. These are secured by nuts 242 and 244 respectively to provide a journaled bearing surface by axles 240 and 241 upon which bearings of the rollers 190, 192, 194 and 196 can turn.

The rollers 190, 192, 194 and 196 can be journaled on any type of bearing surface with ball bearings, roller bearings, or merely a friction bearing. The main support rollers 190 and 192 are shown also provided with bearings internal thereof attached to their axles 240 and 241 for rolling movement. The rollers 190 and 192 are retained by any means to the ends of the axles 240 and 241.

The foregoing roller and support configuration provided by the rollers 190 and 192 support the interior surfaces of the channels 162 as they rest thereon. To further enhance the operation, the flats or extensions 170 in conjunction with rollers 194 and 196 allow for rigidifying and maintenance of the movement of the foot links so that the combination maintains the foot links with regard to upper and lower movement and stability in both vertical directions. This is based upon the rollers 194 and 196 being journaled and engaging the flats 170 by downwardly rolling forces.

The upright ground member 138 as previously mentioned passes upwardly through the foot links 108 and is received within a slot 260 which can be seen in greater detail in FIG. 5 as a slot in the underlying surface 152 of the foot link 108. This allows for reciprocating movement of the foot link 108 with the upright ground member 138 passing through the slot 260. This permits a connection of the ground to a flexible member which will be detailed hereinafter which serves to move the foot pedals 102 and 104 in relative motion to the foot links 106 and 108.

The foot pedals 102 and 104 can be seen as supported on the foot links 106 and 108 in the various showings hereof. Specifically, foot pedal 104 has been shown on foot link 108 supported by three pairs of rollers. The rollers at the front and back respectively provide the underlying support at the front and the back when rolling on respective channels 164. These particular rollers can be seen as rollers 302 and 304 sectioned in the direction of lines 8-8 of FIG. 3 so that they are detailed in FIG. 8. These rollers 302 and 304 are matched by a second pair of rollers at the front area of the foot pedal 104. Each pair of rollers is supported by an axle such as axle 306 at the rear and axle 308 that are secured by nuts on either side. These nuts are analogous to nuts 340 shown in FIG. 7 and can be substituted by flanged fittings, cap nuts, or other means for securing the axle 306 with the rollers 302 and 304 thereon. These rollers 302 and 304 have bearing surfaces which allow them to roll on the axle or in the alternative, the axle can be seated and journaled in the foot pedal 104 so as to provide for rotational axial movement. The respective rollers 302 and 304 and those on axle 308 which are not shown ride in the channels 164 to provide resting support for the foot pedal 104 as it moves backwardly and forwardly.

The rollers 302 and 304 are secured by spacers 318, or bearings and end securements 320 on either end or side thereof. Other suitable means such as bearing locks, caps, or other means can be utilized. Suffice it to say, the rollers 302 and 304 move backwardly and forwardly with rollers on axle 308 and support the foot pedal 104 on the foot link 108 insofar as the pair of rollers mounted on axles 306 and 308 are concerned.

Figure 7:
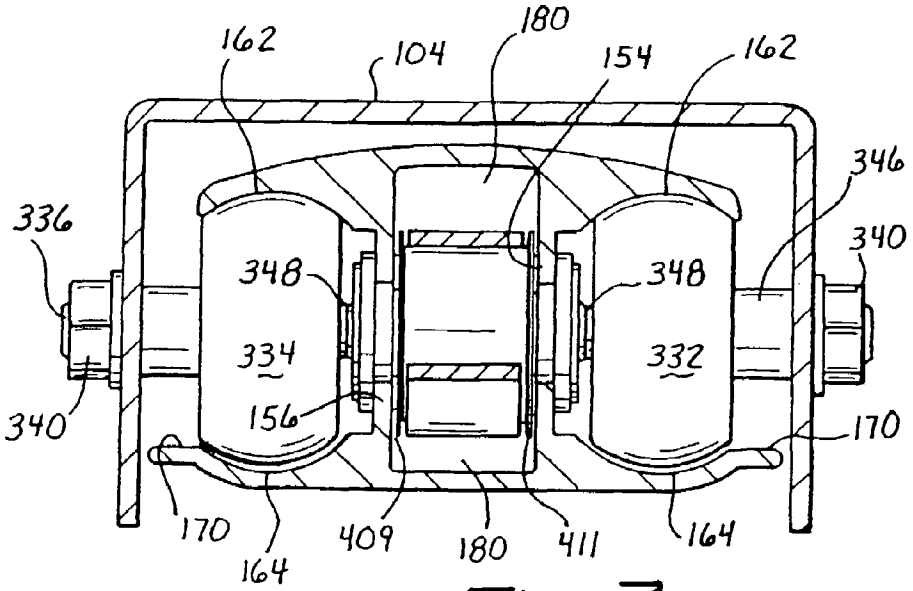
FIG. 7 shows a sectional view of the foot pedal and roller supports as sectioned along lines 7-7 of FIG. 3.

The third set of rollers shown in the sectional view of FIG. 7 are rollers 332 and 334 which are also supported on an axle 336 passing through the foot pedal 104. This axle 336 allows for the rollers 332 and 334 to ride thereon. Axle 336 in like manner to axles 306 and 308 is secured by a nut 340 on either end and includes spacers and bearings respectively 346 and 348.

The rollers 332 and 334 are offset with regard to their axles in an upward manner from the axles 306 and 308. In this manner, they exert an upward force against the arcuate convex channel portions 162. The rollers 332 and 334 provide this upward lifting force in such a manner as to create a tightened or snug mounting of the foot pedal 104 on the foot link 108 by the central portion pushing upwardly on the foot link 108 as the foot pedal 104 is loaded downwardly against the trough or curved portion 164 of the channels by the rollers and axles 306 and 308. This can be seen by the space beneath rollers 332 and 334 in FIG. 7. This allows for more stable movement of the foot pedal 104.

In order to allow for movement of the foot pedals 104 on the foot link 108 with the respective axles 306, 308 and 336, a space, slot, or passage is milled or formed in the webs 154 and 156 which can be seen as a slot 360. The slot 360 allows for passage of the axles 306, 308 and 336 as the foot pedal 104 reciprocates backwardly and forwardly in the channels 162 and 164. The clearance for the axles 306, 308 and 336 allows the travel backwardly and forwardly.

Although specific bearing supports have been mentioned for the foot pedals 102 and 104, as well as the links 106 and 108, various other bearing surfaces, rollers, and engagement means can be utilized for sliding movement.

Figure 4:
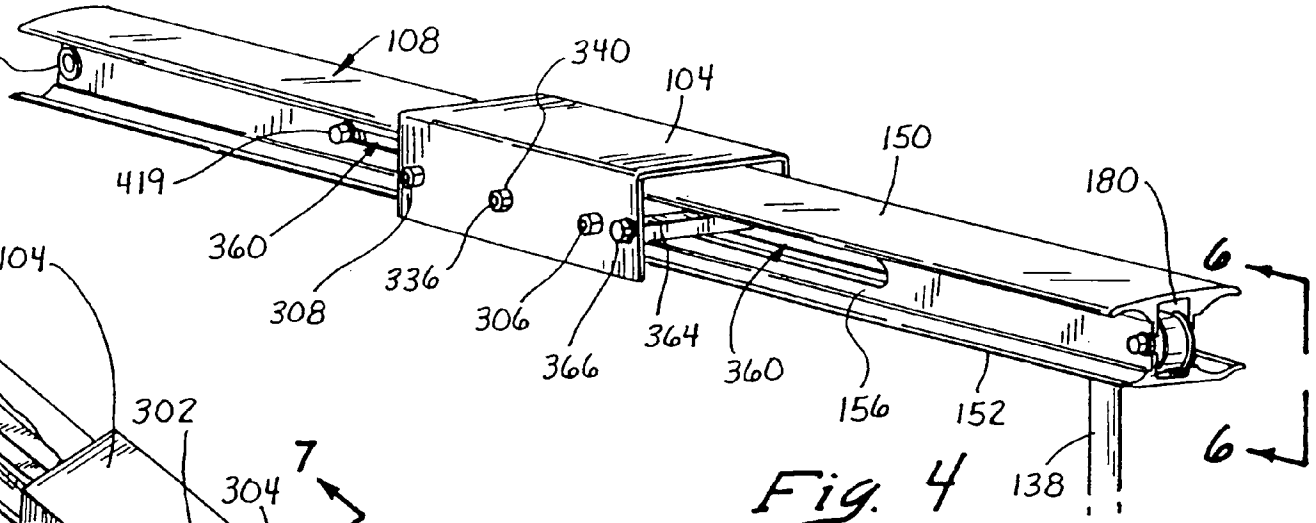
FIG. 4 shows a foot link and foot pedal in the form of a perspective side view.
Figure 3:
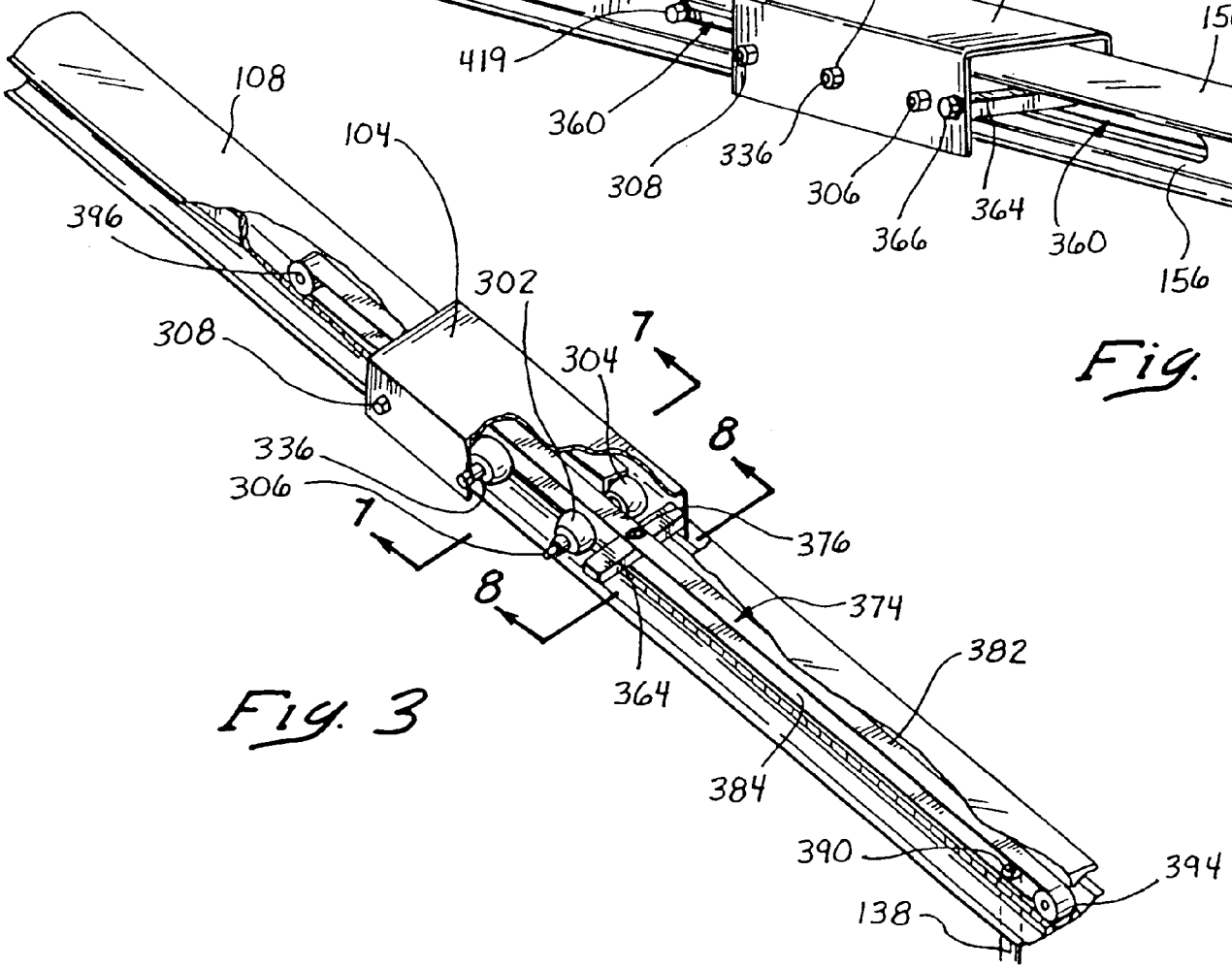
FIG. 3 shows a fragmented partially sectioned view of the foot link of this invention with the foot pedal connected thereto incorporating the flexible member that causes the foot pedal to be moved in relative movement to the foot link.

Looking at FIGS. 3, 4 and 8, it can be seen that a flexible member anchor, securement or strap brace 364 is shown. This anchor 364 is anchored by means of a nut 366 on either side or in the alternative, the rectangular anchoring means can be formed as a rectangular through bolt having nuts 366 on either side. The anchoring member or cross member 364 is connected to an elongated flexible member 374. The elongated flexible member 374 is secured to the anchoring member 364 in this case by means of a bolt 376 and washer 378. However, the flexible member 374 can be clamped, cinched or in any way affixed to the foot pedal 104 in a suitable manner so that it is secured thereto and moves with and can pull the foot pedal 104.

The bolt or screw attaching to the anchor 364 can be seen in FIG. 8 as the bolt head 376 with the washer 378. The flexible member 374 passes through the tunnel elongated opening or passage 180 and can be seen with its upper portion 382 and lower portion of the flexible member belt or cable 384. These respective upper and lower portions as can be seen are such wherein the upper portion 382 is anchored by the anchoring means in the form of the screw and washer to the cross member 364. However, it can be anchored by any suitable means so long as it is able to move drive and/or pull the foot pedal 104 in the manner as described hereinafter.

The lower portion of the flexible member belt or cable 384 is anchored to the ground 138 as previously mentioned. Thus, its affixation continues downwardly from the ground to the base of the frame through the structure as previously stated. This ground 138 extends as an extension upwardly and is connected to the lower portion by means of a bolt and washer configuration 390 similar to that of the bolt and washer or screw and washer 376 and 378. The securement can be in any suitable manner by clamping and holding the lower portion 384 so that it is fixed with regard to the ground position 138 and such that it does not move therefrom in any appreciable manner.

The flexible member 374 is wrapped around a pair of belt pulleys or sheaves respectively at the back and distal therefrom toward the front. These respective pulleys or sheaves comprise a back belt pulley 394 and a front pulley 396. This is also seen graphically in FIG. 6 wherein the back or rearward belt pulley 394 has a pair of flanges 395 and 397 on either side thereof. These flanges 395 and 397 serve to hold the belt 374 in a central position on the belt pulley. In order to journal the rearward belt pulley 394, it can be seen that a bolt or other journaling means passes through the center thereof having bearings. In this case, the bolt comprises a bolt 401 with a head 403 and a nut 405 to secure the belt pulley 394 thereto.

In like manner, the belt pulley 396 is secured similarly to the side walls of the inside of the channels namely side walls 154 and 156. This can be seen wherein the sheave or pulley flanged side walls analogous to those shown on the rear belt pulley 394, namely flanged side walls 409 and 411 are shown in FIG. 7 within the tunnel or elongated cavity 180. The belt pulley 396 is journaled on an axle with bearings seen in FIG. 7 and partially seen in FIG. 4 with a nut 419 securing the axle.

These belt pulleys 394 and 396 which will be described hereinafter as belt pulleys to distinguish them from the other rollers comprise a sheave, turning means, or other element to allow the flexible member 374 to rotate around them as the foot link 108 moves, in a manner to be described.

It should be noted that the axis of the belt pulley 394 can not be moved any farther forward than the point of anchoring of the belt at the point where it is secured by securement 390 to the ground 138. Also to this extent, the belt pulley 396 can not be moved backwardly into the area of the foot pedal 104 to the point where it entangles or disorients the movement of the foot pedal by impinging or engaging against the forward axle 308 of the foot pedal. Within these constraints also it should be understood that the movement of the foot pedal 104 should be allowed to move with respect to the foot link 108 in a non-binding and free manner to provide for the increased stride of this invention in a manner so that it does not restrict the reciprocal movement of the foot links 106 and 108.

In effect, what happens, is as the foot link 108 moves backwardly, it tends to push the belt pulley 394 relative to the ground backwardly. This in turn pulls the flexible member backwardly so that the upper strap portion cable or other flexible member portion 382 tends to pull the foot pedal 104 backwardly due to the fact it is secured thereto at the connection or anchor 376. As it pulls the foot pedal 104 backwardly, it pulls it along the top of the foot link 108. At the same time, while pulling the top portion 382 of the flexible member, the bottom portion 384 tends to pay out and wrap around the belt pulley 396 as it moves around the axis thereof. The flexible member 374 is a continuous looped member so that it pulls by the relative motion of the belt pulley 394 driving it backwardly while feeding around the belt pulley 396.

As the foot link 108 moves forwardly, it moves the belt pulley 396 so as to pull forwardly the foot pedal 104. Thus, at this point the pulley 396 serves as a driving roller by pulling the connection point or anchor 376 and the attendant foot pedal 104 forwardly as the rear belt pulley pays out the upper portion 382 of the flexible member 374 forwardly. In this manner, relative motion is multiplied by a factor of four times the length of the crank arm 92 as will be seen in the crank arm description in the Figures described hereinafter. Other means to impart this relative motion within the foot link 108 can also be accommodated such as by the substitution of a rack and pinion respectively for the flexible member 374 and the belt pulleys 394 and 396. Also, aside from a rack and pinion and various cable configurations, it should be understood that levers and anchoring points can be utilized to enhance this principle of the doubling movement of the normal diameter sweep of the crank arms. In effect a push pull relationship for the foot pedals 102 and 104 is established with respect to ground provided by grounded connection 138.

Figure 14:
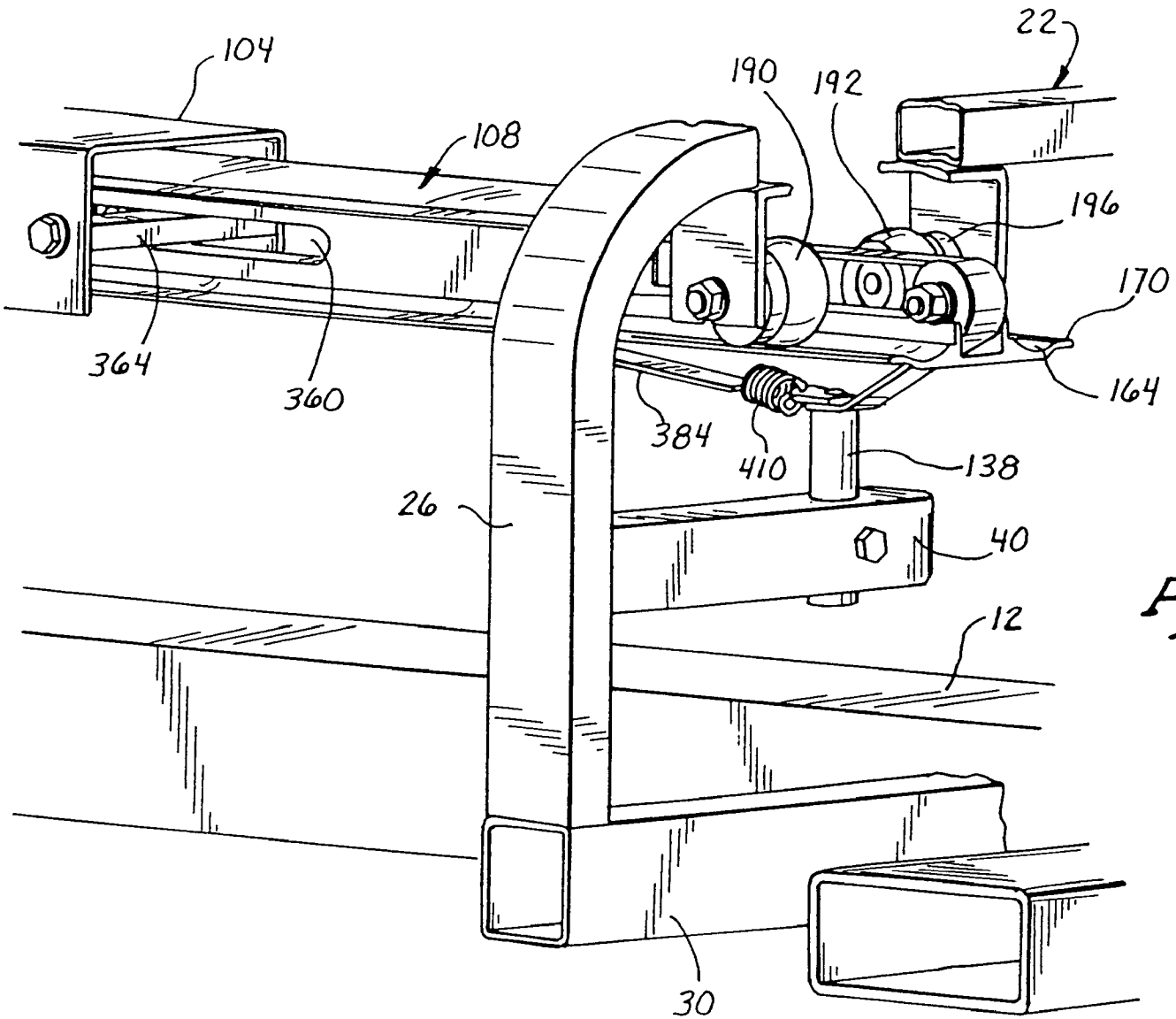
FIG. 14 shows a perspective fragmented broken away view of the rollers that support the foot link with the flexible member having a spring member inter-connected therewith.

Looking at FIG. 14, it can be seen that the rear support rollers 190, 192, 194 and 196 are shown. However, as an alternative, the ground point 138 is secured to the lower portion 384 of the flexible member in part by a spring. This spring allows for retention and belt flexibility so that the belt 374 is maintained in a tightened relationship. However, in general, it is believed that a tightened cable or other means will generally not require the spring tightening shown in FIG. 14. This spring tightening shown in FIG. 14 can not only be a coil spring 410 as shown therein but any other suitable means to take up slack.

Looking specifically at FIGS. 2, 9, 10, 11, and 12, it can be seen that the relative positions have been shown with regard to the crank arms, the foot link, the foot pedal, and the flexible member. The view is of a mid-line view of the foot link, foot pedal and flexible member within the foot link.

Figure 2:
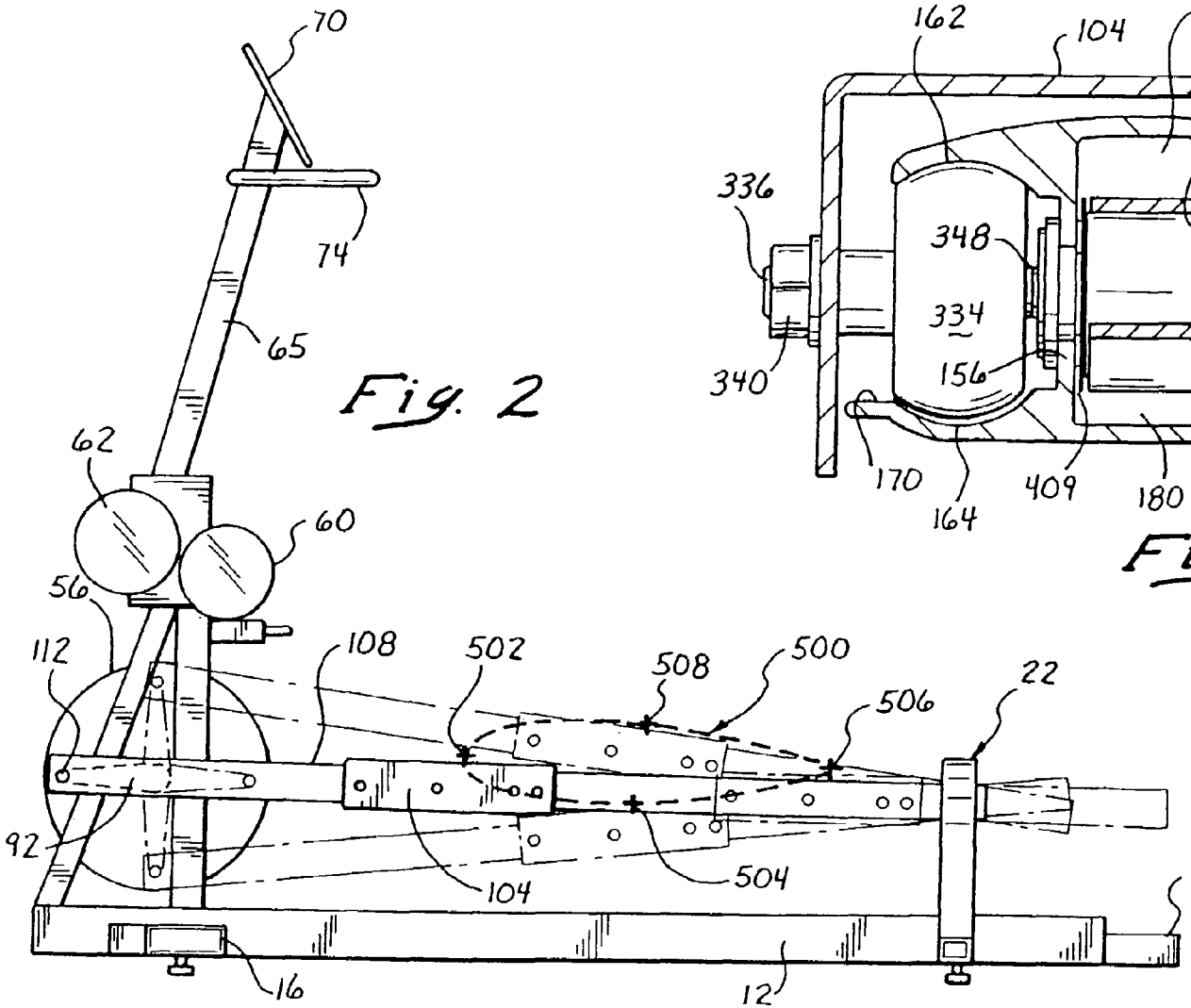
FIG. 2 shows a side elevation view of the exercise trainer of this invention with super-imposed movements of the foot links traveling through a reciprocal movement providing the respective foot pedal orientations as shown.

Looking more specifically at FIG. 2, it can be seen that the frame supporting the exercise and physical therapy trainer of this invention is shown. The respective foot pedals are shown in a dynamic traveling mode in a dotted configuration defined by a dotted curve 500. The dotted curve 500 is somewhat analogous to a degenerated ellipse. An ellipse as purely defined is an elongated circle: a regular oval; specifically: a closed plane curve generated by a point so moving that its distance from a fixed point divided by its distance from a fixed line is a positive constant less than 1. However, in this particular case it can be seen that this is fundamentally a degenerated or modified ellipse 500 having an elongated or major axis between two particular points.

For illustration purposes initially the operation of the foot pedal is such wherein a user's foot at point 502 is when the crank 92 is in the horizontal position. The crank connector 112 is at the farthest position defined by approximately a point 90° counter clockwise from its top position. Also the position of a person's foot 502 is in the most forward position with regard to the foot pedal 104 on the foot link 108. As the foot pedal 104 is pushed downwardly, thereby orienting the crank an additional 90° so that the crank arm is moved 180° counter clockwise from the top position, the point of the foot 504 is moved backwardly. As the crank moves backwardly more with the relative movement of the foot pedal 104 moving backwardly the crank is approximately 270° in counter clockwise movement from the top position. At this point the foot position at point 506 is in its furthest position backwardly.

As the foot link 108 moves forwardly by the crank arm moving to the top position, the foot position 508 changes so that it is at the top of the modified ellipse. The modified ellipse 500 describes the foot and foot pedal 104 positions 502, 504, 506, and 508 respectively with regard to the crank positions. The modified dotted configuration 500 is such where it defines the movement as shown so that a smooth generally modified elliptical path is achieved. This somewhat corresponds to a running or jogging motion for movement rather than a mere straight up and down or sliding movement. It can also be noted that the position of the foot moving from position 502 to 506 is such wherein the major axis of the modified elliptical like configuration 500 with respect to ground is four times the crank length. Thus the overall multiplier effect of two creates an increase of a factor of four times the crank length.

Figure 9:
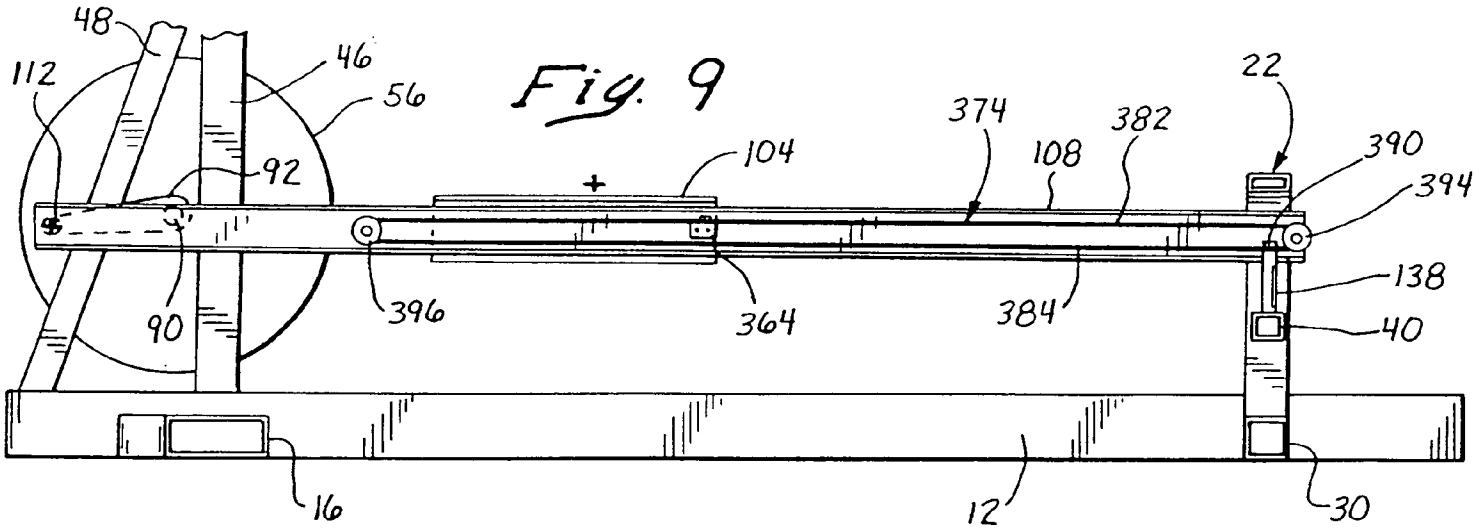
FIG. 9 shows a mid-line sectional view of the foot link and foot pedal starting from a level position with the crank arm fully extended forwardly.
Figure 10:
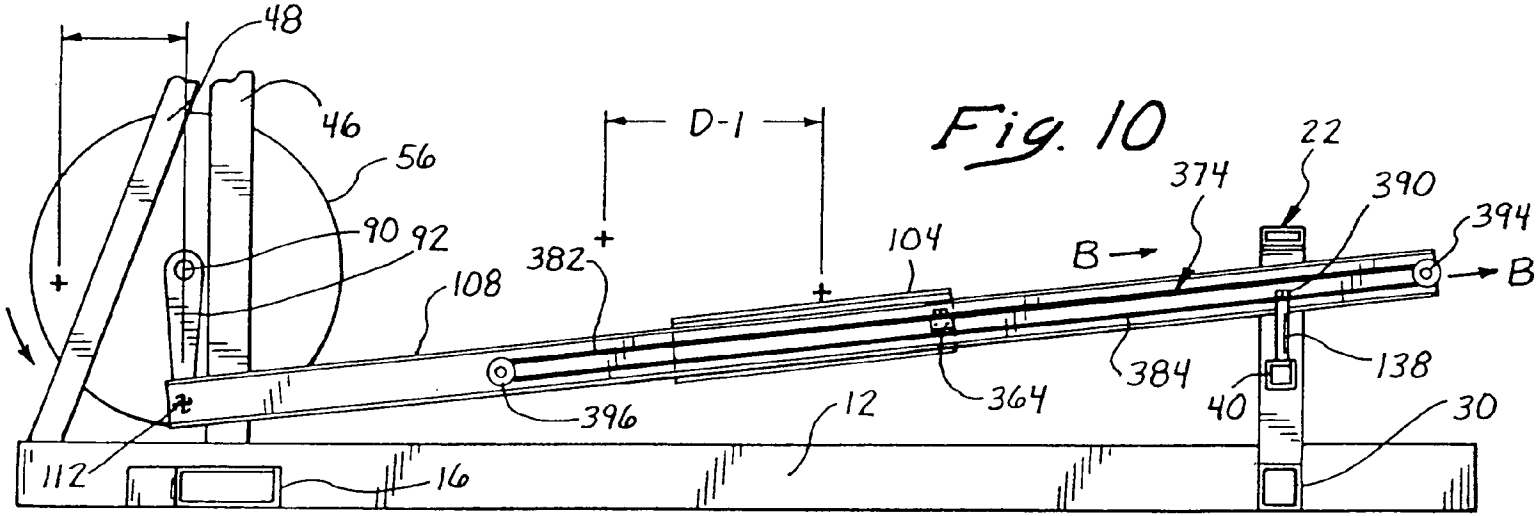
FIG. 10 shows a mid-line sectional view of the foot link and the foot pedal with the crank arm in its lowered position.

Looking more particularly at FIGS. 9, 10, 11, and 12 it can be seen that the relationship as defined in FIG. 2 is shown with regard to the movement of the flexible member 374. In order to orient the operation, the first position is shown in FIG. 9 and sequencing through FIGS. 10, 11, and 12.

FIG. 9 shows the crank in its most forward position which accordingly is the position of the foot link connected at its journaled bearing location 112. This is approximately at 90° from top center in a counter clockwise movement or at approximately nine o'clock. At this point, the foot pedal 104 and the location of a user's foot can be seen in the most forward position of the exercise movement.

The foot pedal 104 is then driven backwardly from its most forward position. It will now be seen wherein by moving to the position of FIG. 10, which is 90° from the prior position of FIG. 9, or approximately 180° from the top center position moving counter clockwise to six o'clock, that the foot link 108 has been moved backwardly. The foot pedal 104 has moved a given distance D1 with respect to ground. This given distance D1 is accommodated by the belt pulley 394 being journaled to and driven by the foot link 108 backwardly in the direction of arrow B. This thereby pulls the upper portion 382 of the flexible member backwardly thereby pulling the anchor point 364 of the foot pedal backwardly so that the foot pedal 104 moves relatively along the top of the foot link 108.

Figure 11:
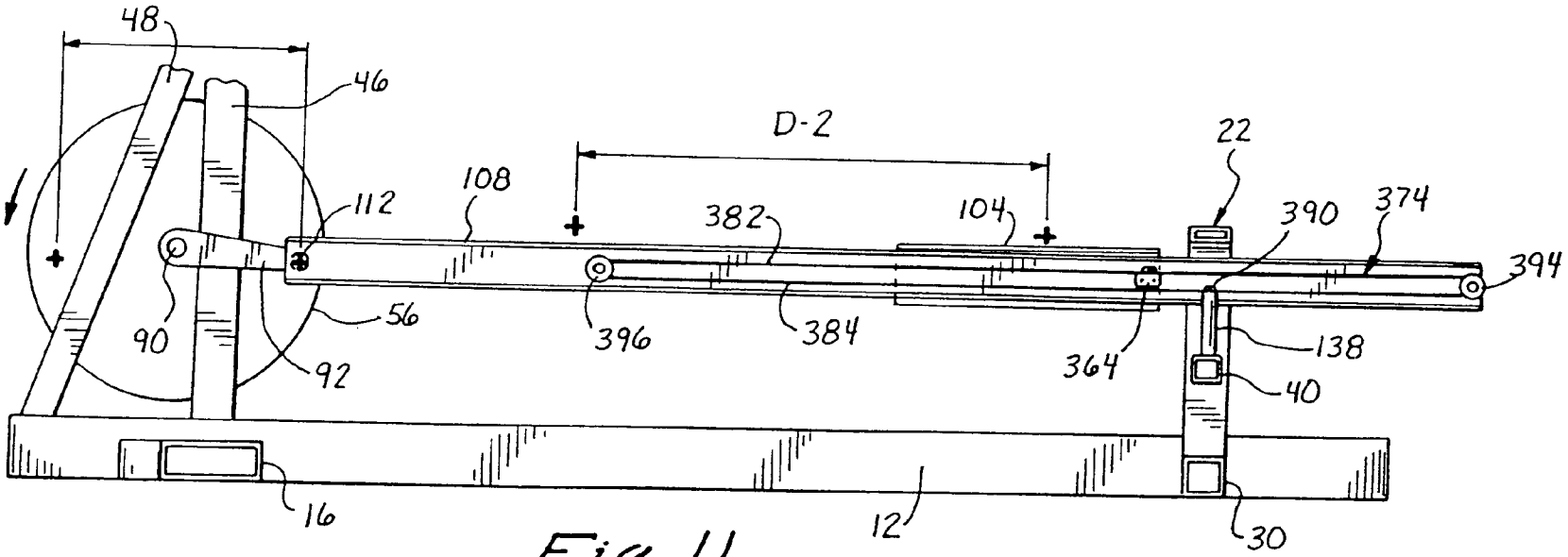
FIG. 11 shows a mid-line sectional view of the foot link and foot pedal with the crank arm in its rearward extended position and the foot link relatively flat.

As the foot link 108 moves farther backwardly, the foot pedal 104 also moves backwardly in relation thereto and to ground as shown in FIG. 11. In FIG. 11, the crank 192 has moved a full 270° from the top position or 180° backwardly to a position at three o'clock. The distance that the foot pedal moves is shown as D2. D2 is the distance of substantially four times the crank length. From this point, with further movement, the foot pedal 104 then moves forwardly as seen in FIG. 12.

Figure 12:
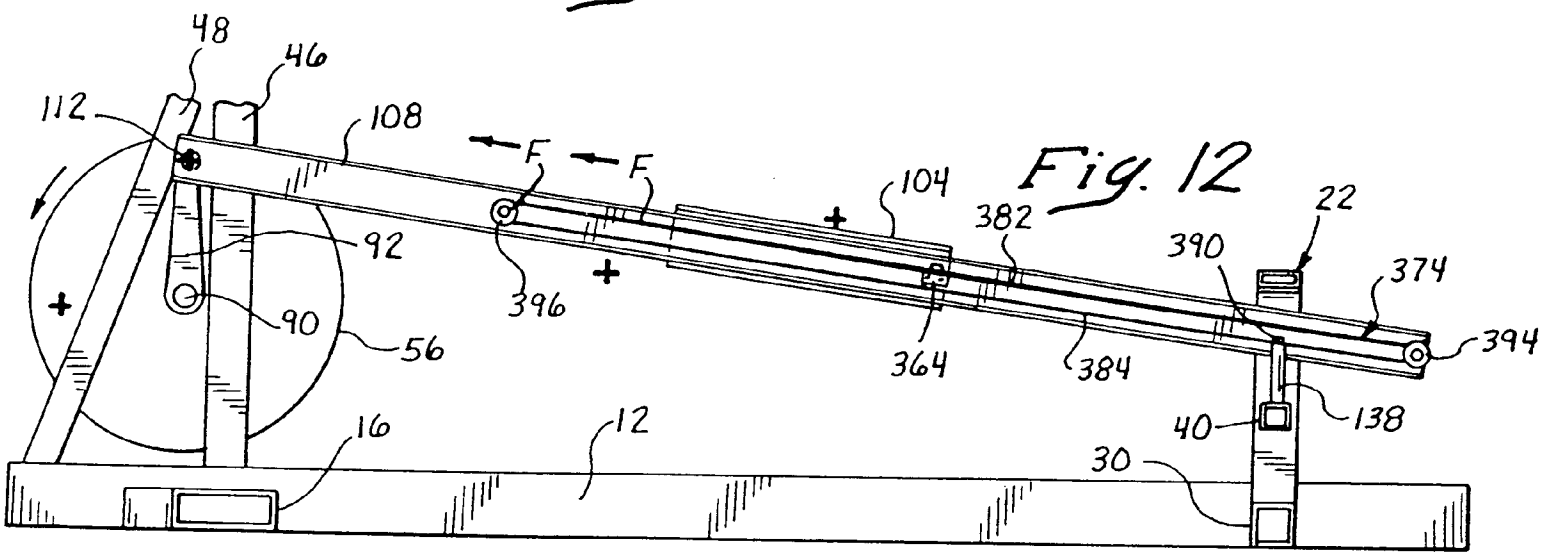
FIG. 12 shows a mid-line sectional view of the foot link and foot pedal with the crank arm in its full upright position.

In FIG. 12, the foot link 108 has moved forwardly to its top position or at twelve o'clock a full 270° from the position shown in FIG. 9. The distance and movement from the rear position of D2 is D2 minus D1 with the foot pedal being in the upper position. This is caused by the belt pulley 396 pulling the foot pedal 104 forwardly from its anchor point 364 due to the fact that the relative position of the belt pulley 396 is moving forwardly in the direction of arrow F. The overall effect is to move the upper belt member 382 forwardly while feeding out the lower belt member 384 so that it travels around the belt pulley 394 in the opposite direction from the way it was traveling when the movement was in the direction of arrow B.

From the foregoing it can be seen that the overall movement of the foot pedal 104 has gone upwardly and downwardly in a roughly modified elliptical manner as shown by the outline 500 of FIG. 2. This makes a smooth curvilinear transition from the forward position indicated at point 502 on the foot pedal back to point 506 and then forwardly again to point 502. As can be understood, any principle involving such an effect by a rack and pinion or linkages substituting the flexible member 374 and the belt pulleys 394 and 396 can be utilized. Such means would be a rack and pinion or combination thereof in the alternative to belts and pulleys, cables, chains, or other means. Of course, chains can be effectuated with the utilization of sprockets or other means substituting for the belt pulleys 394 and 396. All the foregoing can effect the same movement of driving the foot pedal 104 backwardly and forwardly from its relative position on the foot link in relationship to ground as established by the ground 138 connected to the frame in its fixed location.

Figure 16:
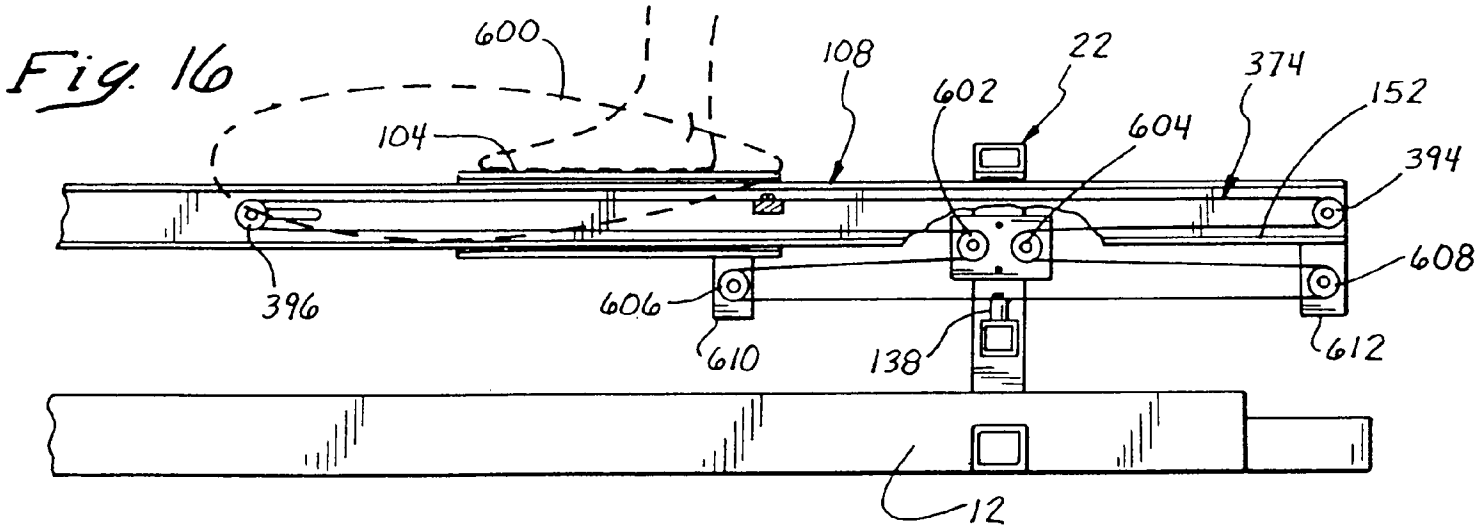
FIG. 16 shows a sectional view of a flexible member which can extend the crank length for reciprocating movement by a factor of just under six.
Figure 17:
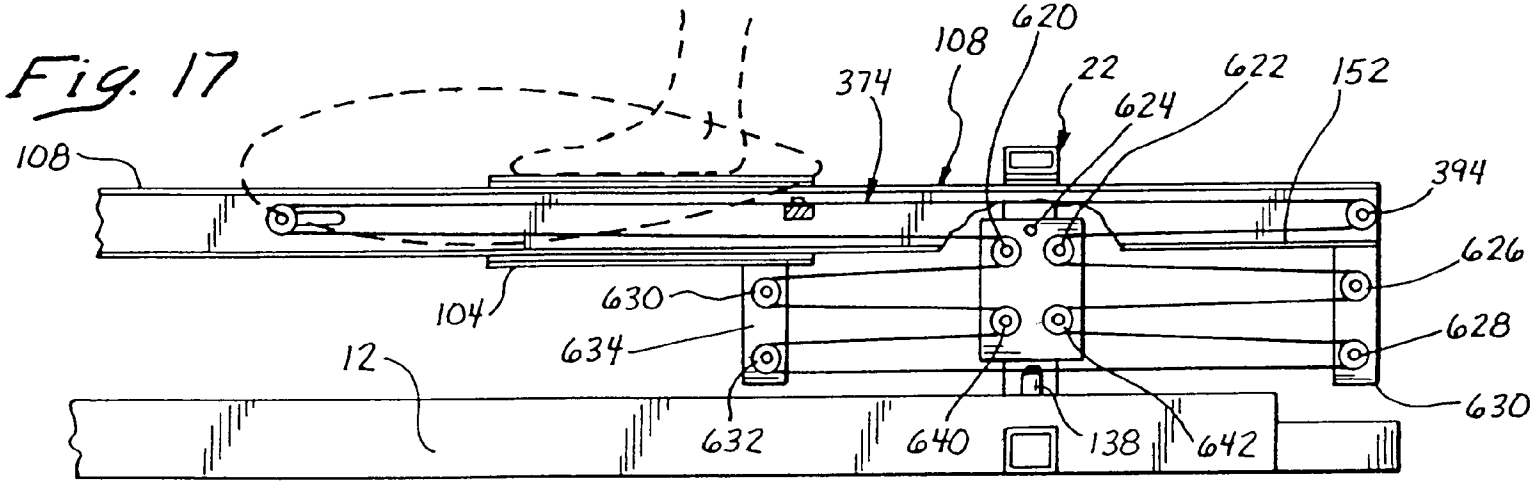
FIG. 17 shows a sectional view of a flexible member which can extend the crank length for reciprocating movement by a factor of just under eight.

Looking more specifically at FIGS. 16 and 17 it can be seen in FIG. 16 that a generally modified elliptical path 600 has been shown analogous to the prior modified elliptical path 500. In this particular instance, the flexible member has been provided in the manner of the normal flexible member 374 within the foot link 108 with the foot pedal 104 being placed on top of the foot link 108. Here again, pulleys 394 and 396 are in the same orientation as in the prior embodiment. However, in this particular case additional pulley sets are utilized with an additional belt link. In particular, this embodiment incorporates the ground point 138 to which the flexible member or belt is attached. However, a second set of pulleys 602 and 604 are utilized to allow the belt 364 to be fed around each particular pulley 602 and 604 to feed it downwardly. Pulley 602 and 604 are allowed to pivot as the foot link 108 travels upwardly and downwardly or oscillates in its upward and downward motion through its reciprocating movement.

Attached to the foot link in a fixed relationship is a third set of pulleys 606 and 608 that have an attachment in a the form of a bracket 610 and 612 respectively for holding the pulleys 606 and 608. These particular brackets are fixed to the underside of the foot link, namely surface 152. The portion of the belt between pulleys 606 and 608 is affixed to a ground point 138 which is affixed to the frame so that it does not move. This particular arrangement provides for a multiplying effect of substantially six times the length of the crank 92 attached to the foot link 108.

FIG. 17 shows an analogous multiplier which provides substantially eight times the crank length distance. In this particular embodiment, a set of pulleys 620, 622, 640 and 642 are provided which are mounted on a plate that pivots around a pivoting pulley point at the axis thereof, namely pulley point 624.

A second set of pulleys 626 and 628 are attached to a bracket 630 which is rigidly mounted to the underside 152 of the foot link 108.

A third set of pulleys 630 and 632 are mounted to a bracket 634 that is connected to the foot link 108 underside 152 by the bracket so that they move in concert with the foot link. Here again, as analogous to the showing in FIG. 16 the portion of the flexible member 374 that extends between the pulleys 632 and 628 is secured to an analogous ground which is ground 138.

As the foot link 108 travels to the left a given distance, each belt portion connecting the pulley sets will increase a given distance in length. Since there are six connecting belts a single point on the belt next to the foot pedal travels substantially six times that distance. The remaining distance to make up for the factor of eight is derived from the foot link itself moving with respect to the pedal. This provides for a movement of eight times the length of the crank 92.

Figure 18:
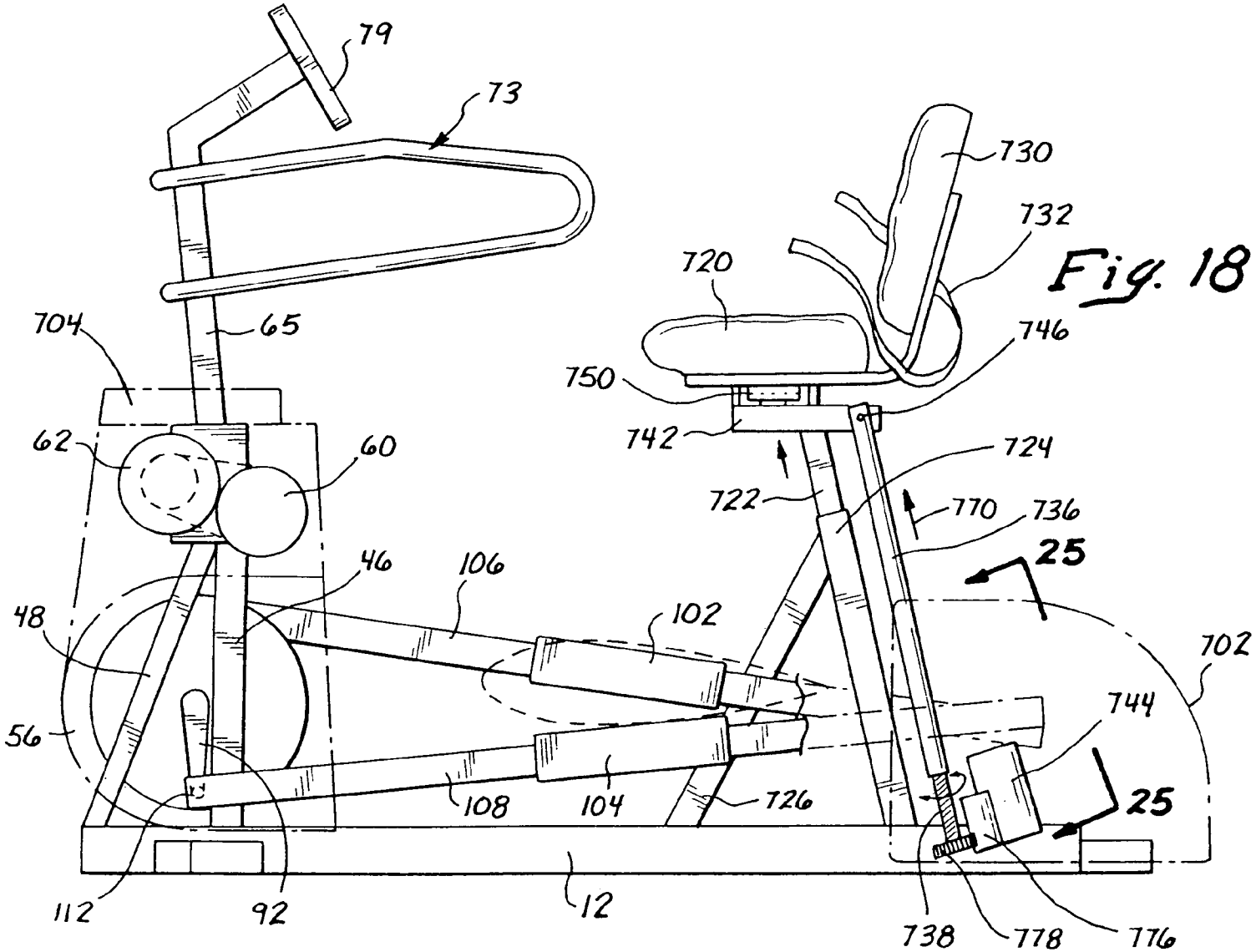
FIG. 18 shows a physical therapy unit employing the moveable seat of this invention.

Look more particularly at FIG. 18, it can be seen that a side elevation view of an alternative embodiment of this invention has been shown.

In particular, it can be seen that the showing in FIG. 18 includes the like foot links 106 and 108. It also includes the like foot pedals 102 and 104. The foregoing are mounted on the base 12. Also, it can be seen where the pulley 56 and sheave 60 are shown with the flywheel 62. All the foregoing are mounted to the structural members 46 and 48. Further to this extent, it can be seen that a crank arm 92 is shown similar to the foregoing description. Also, a control panel 79 analogous to panel 70 provides control functions shown similar to the previous embodiment.

In order to provide upright support, a stanchion 65 is shown with a hand grip rail 73 similar to the hand grip rail 72 in the foregoing embodiment. The only difference being the handle bar 72 and 74 of the foregoing embodiment incorporate a different configuration from that shown as hand grip 73 which is attached to the stanchion 65.

The embodiment shown in FIG. 19 and the remaining figures ancillary thereto incorporate a faring or shroud 702 covering up the rear operating portions of the foot link 106 and 108 attachments. In the forward portion a shroud or faring 704 is shown which also covers up the operative aspects of the pulley 56 and associated cranks and other operating mechanisms.

Figure 20:
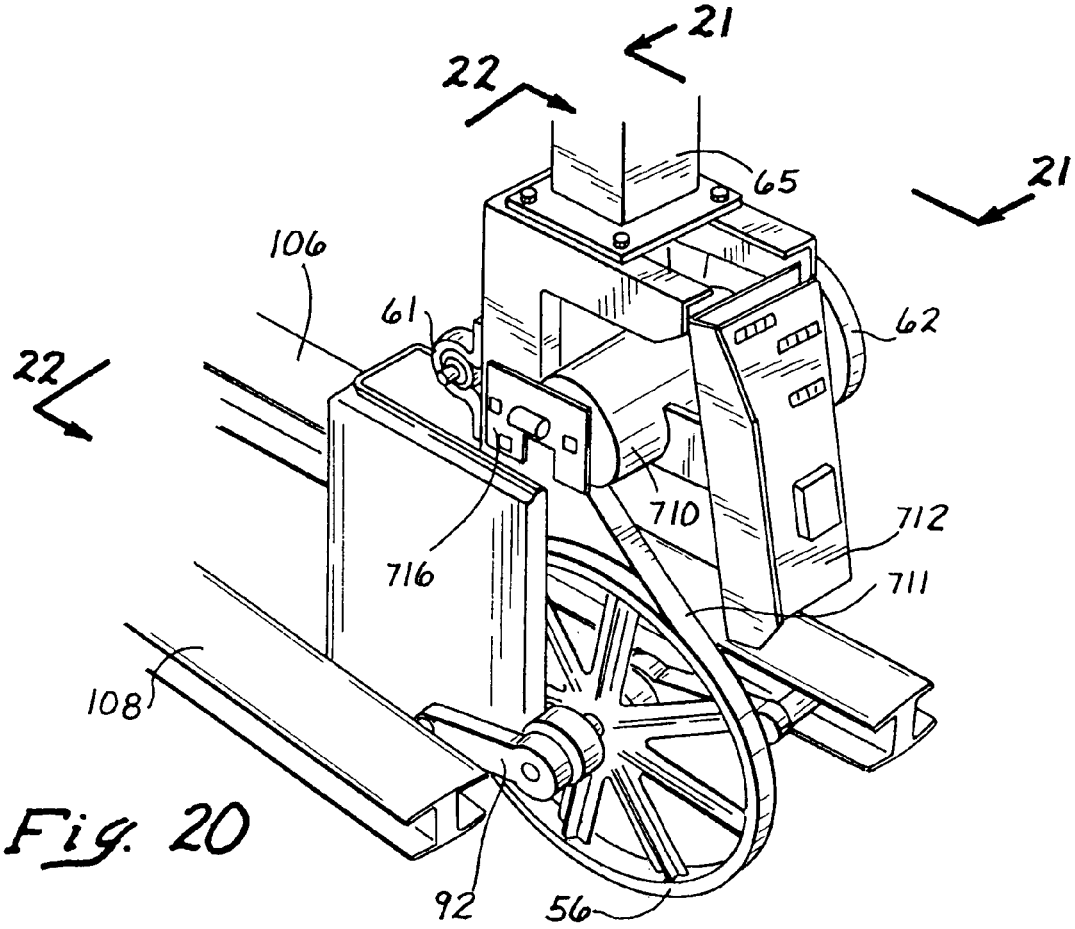
FIG. 20 shows a perspective fragmented detailed view of the crank, foot links, and motor drive of the invention.

A significant variation of this invention is that the alternator or load which is utilized in the prior embodiment is replaced with a D.C. brush motor 710 shown in FIG. 20. The D.C. brush motor 710 forms a drive motor which is controlled by a motor control board 712. The motor control board and its functions will be detailed hereinafter in greater detail in the showing of FIG. 27.

Figure 21:
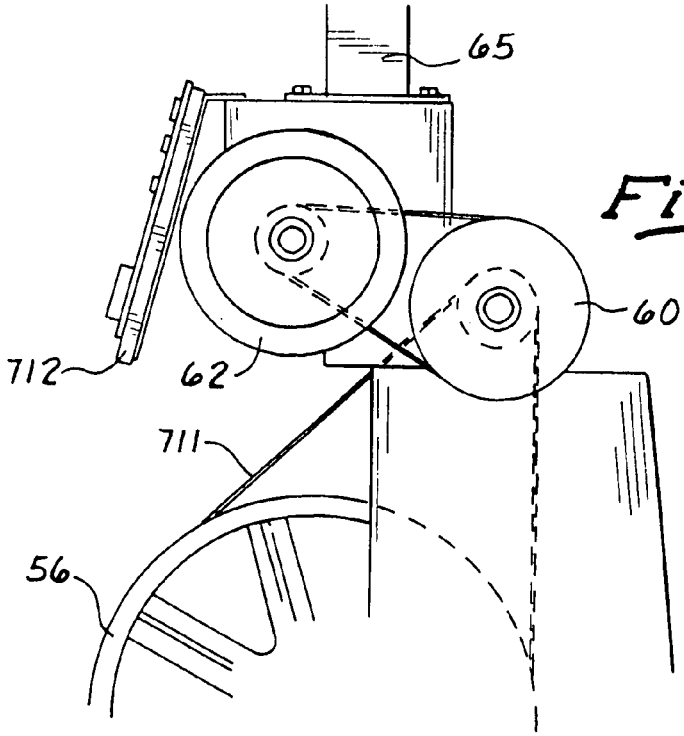
FIG. 21 shows a view in the direction of lines 21-21 of FIG. 20.

The motor 710 shown in FIG. 21 is connected to the flywheel 62 and in turn to the sheave 60 which transmits power to the belt connected to the pulley 56. Transmission is to the crank arms 92 as shown in FIG. 20 connected to each respective foot link 106 and 108, through the belt 711 connected to the sheave 60 through the pillow block mounting 61.

The motor 710 can be of any particular type that is utilized to provide a positive movement under control so that a person can be aided in movement during the exercise process for both limited exercise and physical therapy. Furthermore, the motor 710 when overdriven beyond a preset speed provides for resistance upon the part of the user so that a supplemental effort is encountered by the user.

In order to link the motor to the controls, a filter 716 is provided that reduces RF transients and other noise emanating from the brushes of the motor into the system. The speed of the motor is picked up by a hall sensor in relationship to the shaft of the motor 710 as described in the block diagram of FIG. 27. The hall sensor senses movement of ridges, teeth, knobs, or lands and grooves on a rotating disk attached to the motor 710. The respective pulses provided by each respective tooth, knob, or ridge can be picked up and counted to determine the speed of the motor 710.

From the foregoing, it can be seen that the motor 710 provides a drive and supplemental movement to a user in a physical therapy mode. In other words, if the user can not move the foot pedals 102 and 104 with sufficient strength, the movement is supplemented or completely provided by the power of the motor 710 turning the foot links 106 and 108 through the cranks 92 so as to move the foot pedals 102 and 104. Also, an overdrive or user positive effort can take place whereby a user when a pre-established motor speed has been reached can exert positive effort in order to push the foot pedals 102 and 104 beyond the speed of the motor for further exercise.

Looking more particularly at the showing of FIGS. 18 and 19, it can be seen that a seat 720 has been provided on a sliding column 722. The sliding column 722 is mounted in a tube or sleeve 724. The tube or sleeve 724 is supported by an angular strut 726.

The seat 720 has a back portion 730 against which a user can rest ones back. A seat belt 732 is provided in order to hold a person on the seat 720. This is particularly helpful when a person requiring physical therapy is mounted on the seat 720.

The seat is adjusted upwardly and downwardly on a jack screw threaded tube or sleeve 736 that is in turn driven by a screw 738. The movement of the column or jack screw tube 736 causes movement of the seat 720 upwardly and downwardly in the direction of the arrows shown in FIG. 18. This is due to the connection at connection point 740 to a seat support 742. The seat support 742 is such wherein it mounts the seat 720 on a horizontally angular rotating support so that the seat can be turned for moving it to the side for a person to slide or mount onto the seat.

The details of the seat mount are shown in greater detail in FIG. 24 wherein the rotatable mount is shown. In particular, a disk 750 is shown having notches or detent openings 752. The notches or detent openings 752 allow a pin 754 with a rounded end portion 756 to be placed in the notches 752 at different locations. The pin 754 is controlled by a knob 758 that is spring loaded by a spring 760 which drives the pin 754 into the notches or detent openings 752. Thus, the seat mounting in the form of the disk 750 can rotate in the direction of arrow 764. This accommodates various positions as it swings to approximately 90° to the left or right to allow a person to then sit upon the seat. The user is then rotated on the mounting 742 back to the position to where the user's feet are adapted for placement on the foot pedals 102 and 104.

The seat 720 allows for a person requiring physical therapy to be moved and rotated by the rotatable mounting 750 to any particular position and then helped on to the seat 720.

The accommodation of the seat 720 to a user is enhanced by the jack screw tube 736 being able to move upwardly and downwardly in the direction of arrow 770. This allows the jack screw 738, detailed in FIG. 25, when turned by a motor 774 connected to a gear box 776 to rotate the jack screw through a gear 778 connected to the gear box. When the screw rotates in either direction of the arrow 782 as driven by the motor 774 through the gear box 776, it allows upward and downward adjustment of the seat 720. This is caused by a nut 786 welded to the tube or jack screw sleeve 736 to drive it upwardly and downwardly as the gear 778 turns in either direction of the respective screw 738. In this manner, adjustable seat heights can be accommodated for variably sized users.

When the seat is higher it helps to enhance articulation of the hips to a great degree. When it is lower it enhances greater knee articulation. This is due to the higher seat orientation causing the hips to receive the movement of the legs in a larger flexing arc. When the seat is lower, the knees are more bent and cause a greater arc of movement through the articulated knee action. The result is that a rehabilitation mode can be directed depending upon seat height to the hips or knees of the user.

Figure 27:
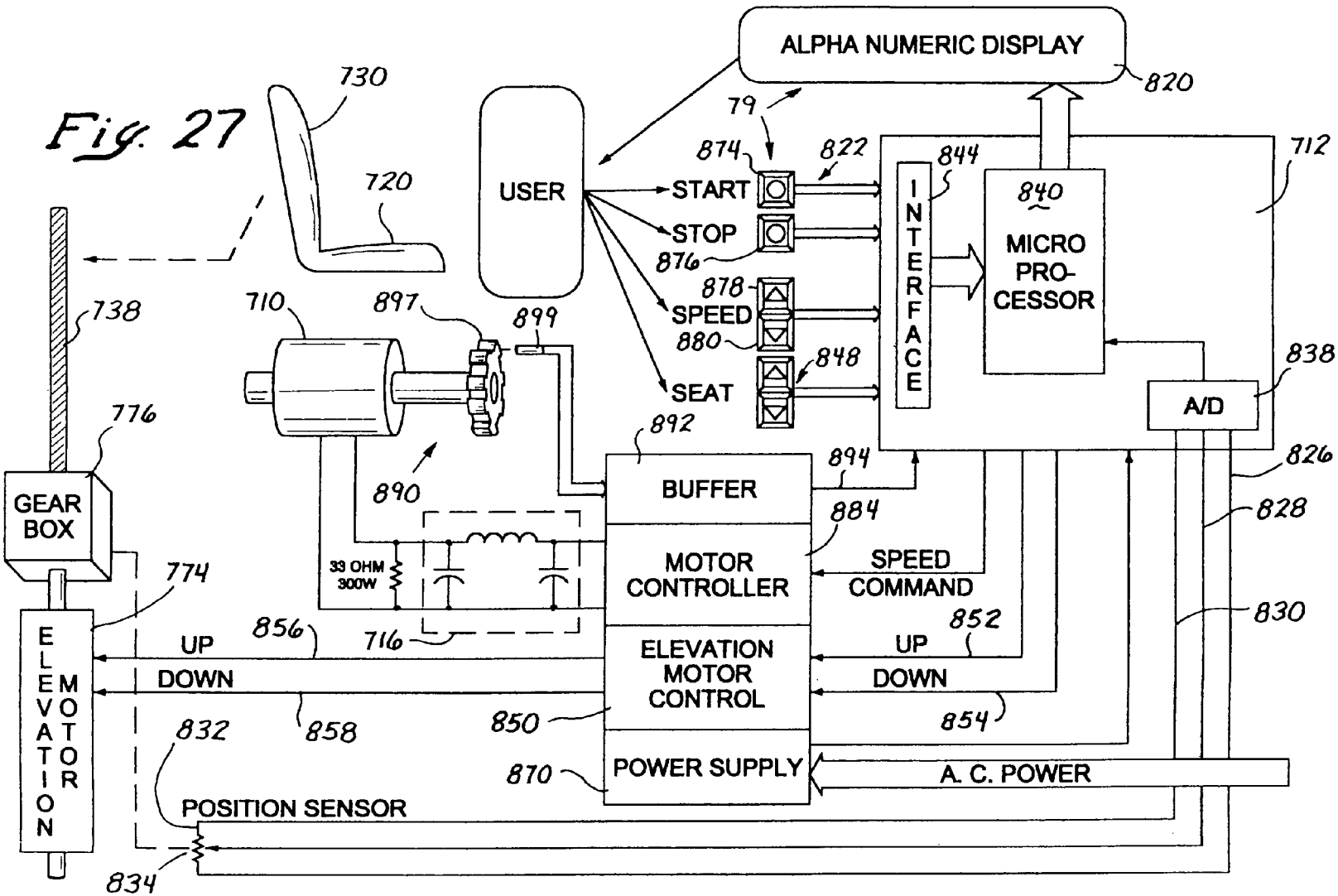
FIG. 27 shows a block diagram of the controls of this invention.

Looking more specifically at FIG. 27, it can be seen that the seat 720 has been shown connected to the gear box 776 and the elevation motor 774. This allows for movement upwardly and downwardly and adjustment of the seat 720 height. This adjustment is accomplished on the panel 79 that has an alpha numeric display 820. A series of switches 822 are shown having a various set of functions.

As can be seen from the motor 774 and the gear box 776, they are interconnected to the control panel 712 through lines 826, 828, and 830. These lines are connected to a position sensor 832 that has a potentiometer 834 to indicate the position of the screw jack 738 and the attendant elevation of the seat 720. These lines 826, 828, and 830 are connected to an analog to digital converter 838. The analog to digital converter takes the signal from the lines and transmits it to a microprocessor 840. The microprocessor 840 on the control panel 712 allows for the control functions of the motor 710 and the elevation motor 774.

An interfacing debouncing circuit 844 allows for the interface of the switches 822 to the microprocessor. Adjustment of the seat 720 through an up and down switch 848 is shown so as to cause the microprocessor to signal an up or down signal to the elevation motor control 850. The motor control 850 is connected to lines 852 and 854 for up and down movement commands of the elevation motor 774 through lines 856 and 858.

In the foregoing manner, the seat 720 can be elevated and depressed depending upon a user's or therapist's desire. The up switch portion of switch 848 allows a user on the alpha numeric display to determine seat height and move the setpoint upwardly. Downward movement by switch 848 causes downward movement of seat 720. Movement control is through the control by the microprocessor 840 as sensed on lines 826, 828, and 830 through the potentiometer 834 of the position sensor 832.

Power is provided from an AC power supply to a system power supply 870. The power supply provides for the power to the respective motors as well as the system power supply for the controls.

In order to control the motor 710, a start and stop switch function is initiated through switches 874 and 876. These effectively turn on the motor 710 and its controls. In order to change the speed, a user pushes buttons for faster or slower speed namely faster speed button 878 and slower speed button 880. These respective buttons allow for the motor to turn at a particular RPM which is desired for a given exercise effort or therapy movement.

The speed switches 878 and 880 feed into an interface unit 844 which provides a debouncing circuit to the microprocessor 840. A speed command is then given to the motor controller 884 in association with the motor 710. This is communicated to the motor 710 through a filter previously mentioned namely filter 716 which has been dotted in. The filter 716 limits electronic noise in both directions to prevent the system controls from being affected.

In order to determine the speed of the motor 710, a speed sensor 890 in the form of a toothed disk 897 and hall effects switch or sensor 899 is secured to the motor shaft as shown. This speed sensor 890 is in the form of a disk 897 having teeth, lands and grooves, or ridges which are sensed by a hall sensor 899. The movement of the ridges is sensed by the hall sensor 899. The signal is transmitted to a buffer 892 which in turn is connected to the control board 712 through line 894. Thus, the speed of the motor 710 can be sensed through the speed pickup 890 and relayed to the microprocessor 840 for controlling the motor appropriately with regard to the pre-established and desired speed control.

The alpha numeric display 820 displays seat 720 height, speed of the motor 710, time of the workout, and total distance traveled. Other functions can be provided depending upon the output of the particular functions desired.

The foregoing sets forth the aspects of the unit which can be used for therapy with and without a seat. In effect, the user can hold on to the handle bar 73 or sit on the seat and have the motor 710 turn the cranks 92 in order to reciprocate the foot links 106 and 108. This allows the user to freely move by the motor 710 providing the effort. The user can also change this particular function so that the motor 710 speed can be increased or decreased depending upon the user's particular desire or the therapist's program. This allows the user to custom design the exercise routine or therapy routine or in the alternative a physical therapist to design a particular program to rehabilitate a user. Thus, the user can be accommodated with a purely motor driven effort or in the alternative a supplemental effort. Seat 720 height effecting the angle of displacement, controls the angle of displacement with respect to the knees and the hips, as previously described.

A supplemental effort is provided when a user reaches a certain speed and then puts in extra effort. This can be through a load system which increases the load either through resistance or other means or creates a drive against the motor which acts as a resistance and goes into an alternator mode depending upon the effort of the user in pushing or overdriving the motor.

This is exemplified in FIG. 23 which shows a set speed of three miles per hour which is established at crossing point 900 along the graph showing the RPM. The motor drive is shown pushing the exerciser up to three miles per hour. At point 900, if the user were to supplement the speed of the motor by pushing against the pedals 102 and 104 positively, the increase would be seen in the form of the curved line extending upwardly as to the direction of load.

Thus, depending upon how much effort the user puts in beyond the speed of three miles per hour, the supplemental load on the user enhances the workout without a full workout but at the same time providing for therapy on a graduated basis. With this in mind, it can be seen that therapy can be provided by a particular motor driven motion while at the same time increasing it with a small increment of load to a user to provide physical therapy for those not capable of making a full effort against the foot pedals 102 and 104.

Figure 28:
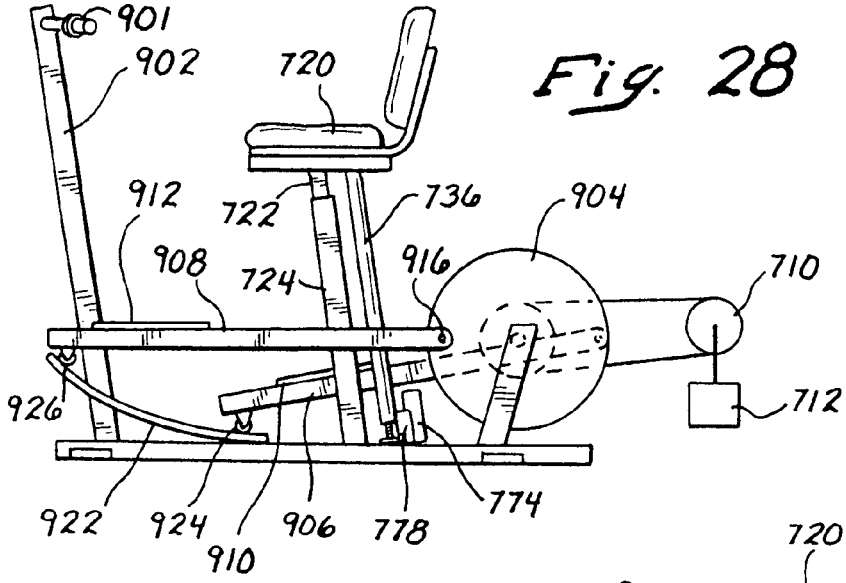
FIG. 28 shows an alternative embodiment of this invention.

Looking more specifically at FIG. 28 it can be seen that a seat 720 has been provided with the adjustment drive system including the jack screw column or sleeve 736 with the drive motor 774 and gear box 778. A handle bar 90 is provided attached to a column 902. The seat 720 adjusts upwardly and downwardly on the guiding column 722 within a sleeve 724.

Figure 29:
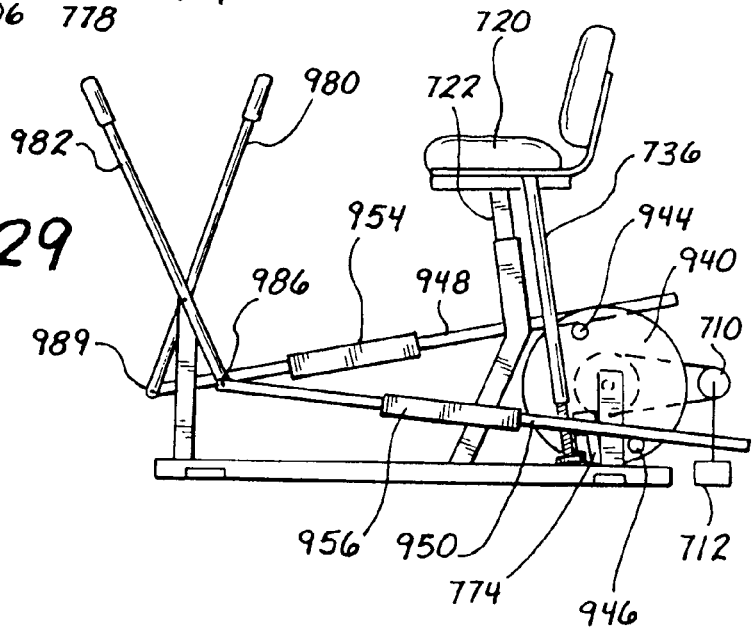
FIG. 29 shows a second alternative embodiment of this invention.
Figure 22:
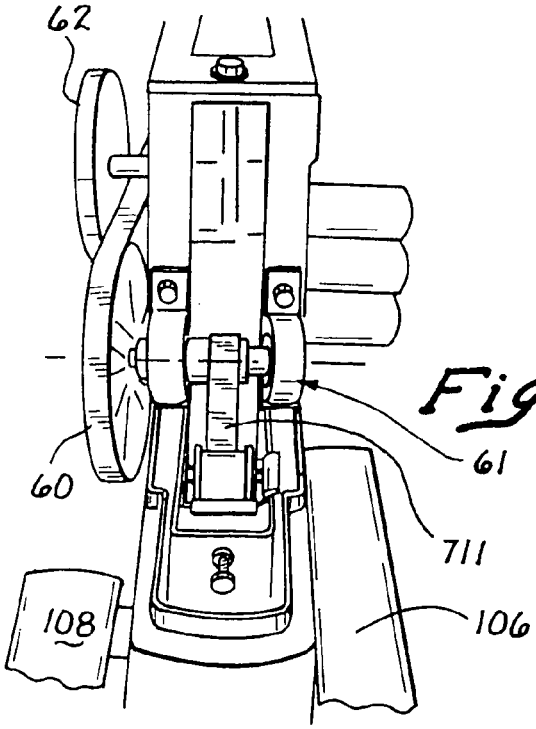
FIG. 22 shows a rear elevation view of the crank and flywheel assembly of this invention.
Figure 26:
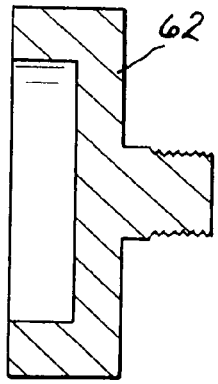
FIG. 26 shows a sectional view of the flywheel.

In FIGS. 28 and 29 alternate embodiments are shown. The entire exerciser is shown having a flywheel 904 connected to foot links 906 and 908. The foot links have respective foot pedals 910 and 912. The respective links 906 and 908 are connected to the flywheel 904 by means of a linkage pin 916 on either side.

The flywheel is driven by a motor such as motor 710 connected to a motor control 712 similar to the prior embodiments. In this manner, the speed of the flywheel 904 can be controlled.

The movement of the pedals 910 and 912 upwardly and downwardly is provided by an arcuate track on either side, one of which is shown namely arcuate track 922 having a roller. The respective links 906 and 908 have respective rollers 924 and 926 which ride in the arcuate track 922 to provide an elliptical movement of the foot pedals 910 and 912.

A control mechanism with an alpha numeric display such as that of 820 can be provided in any suitable location for controlling the motor 710 so that speed can be adjusted upwardly and downwardly as in the prior embodiment.

Looking more particularly at FIG. 29 it can be seen that a seat 720 is also shown with a flywheel 940 connected to the motor 710 and motor control 712. The flywheel 940 turns around and has a pair of rollers 944 and 946 on either side that lifts foot links 948 and 950 in an upward and downward reciprocating manner. Foot pedals 954 and 956 are provided in a order to provide the user with exercise similar to those movements set forth hereinbefore.

An adjustable jack screw sleeve 736 is also provided with an elevation motor 774 as in the prior embodiments. Also an adjustment seat support column 722 allows the seat to be raised up and down within a column support.

Attached to the forward portion of the foot links 948 and 950 are handles 980 and 982 connected by pivotal connections 984 and 986. The pivotal connections 984 and 986 allow for one to grip the handles 980 and 982 while at the same time being seated and provide for elliptical movement of the user's feet on the foot pedals 954 and 956. The embodiment with the motor 710 and the motor controller 712 can provide the same type of driven motion as set forth in the embodiments hereinbefore.

What is claimed is:

1. An exercise trainer that provides a simulated walking or running stride, said trainer comprising a frame, a seat supported by said frame, a first rotational crank and a second rotational crank coupled to a first location on said frame, a first foot link having a first end and a second end, a second foot link having a first end and a second end, said first end of said first link being connected to said first crank and said first end of said second link being connected to said second crank, a first foot pedal movably connected to said first link between said first end and said second end of said first link, a second foot pedal movably connected to said second link between said first end and said second end of said second link, said first foot pedal capable of traveling along a portion of said first link and said second foot pedal capable of traveling along a portion of said second link, a first flexible member extending between said first foot pedal and a first fixed location on said frame, a second flexible member extending between said second foot pedal and a second fixed location on said frame.

2. The exercise trainer of claim 1, wherein said first and second crank are connected to a motor such that said first and second cranks are capable of being motor-driven.

3. The exercise trainer of claim 1 further comprising a motor, said motor being coupled to said first and second cranks, said motor being configured to be overdriven by input from said first and second cranks.

4. The exercise trainer of claim 1, wherein each of said foot links is supported by one or more rollers at said second end.

5. The exercise trainer of claim 1, wherein said flexible member is selected from the group consisting of a belt, a chain and a cable.

6. The exercise trainer of claim 1, wherein said first and second fixed locations are defined by a single location.

7. The exercise trainer of claim 1, wherein said first and second fixed locations extend from a post that forms part of said frame.

8. The exercise trainer of claim 1 further comprising multiple pulleys mounted to each said link with each respective said flexible member being looped around said corresponding multiple pulleys.

9. The exercise trainer of claim 8, wherein said first link comprises two pulleys that are mounted to said first link with said first foot pedal being positioned between said two pulleys.

10. The exercise trainer of claim 9, wherein said two pulleys comprise a front pulley and a rear pulley and said rear pulley being positioned behind said first fixed location.

11. The exercise trainer of claim 1, wherein said seat is adjustable by a motor.

12. The exercise trainer of claim 11, wherein said motor drives said seat in a generally vertical direction.

13. The exercise trainer of claim 1, wherein said seat swivels relative to said frame.

14. The exercise trainer of claim 1, wherein at least one arm rest is attached to said frame at a location forward of said seat.

15. The exercise trainer of claim 1 further comprising a shroud that encloses said cranks.

16. The exercise trainer of claim 1 further comprising a motor, said motor being connected to a flywheel, said flywheel being connected to a sheeve, said sheeve being connected to a pulley and said pulley being connected to at least one of said first and second cranks.

17. The exercise trainer of claim 16, wherein said motor is a DC brush motor.

* * * * *

UNITED STATES PATENT AND TRADEMARK OFFICE

CERTIFICATE OF CORRECTION

PATENT NO. : 7,267,637 B2
APPLICATION NO. : 11/154850
DATED : September 11, 2007
INVENTOR(S) : F. Mercado et al.

It is certified that error appears in the above-identified patent and that said Letters Patent is hereby corrected as shown below:

Title page, Item (73) (Assignee), after "Inc.," please insert --dba Star Trac--.

Signed and Sealed this

Twentieth Day of May, 2008

JON W. DUDAS
*Director of the United States Patent and Trademark Office*